US006459874B2

(12) United States Patent
Inoue et al.

(10) Patent No.: US 6,459,874 B2
(45) Date of Patent: Oct. 1, 2002

(54) DEVELOPING SYSTEM FOR FORMING A FULL-COLOR IMAGE

(75) Inventors: Masahide Inoue, Nara-Ken; Masahiro Anno, Sakai; Chikara Tsutsui, Nishinomiya; Minoru Nakamura, Takarazuka; Katsunori Kurose, Amagasaki, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/778,951

(22) Filed: Feb. 8, 2001

(30) Foreign Application Priority Data

Feb. 14, 2000 (JP) ..... 2000-034966

(51) Int. Cl.[7] ..... G03G 15/01

(52) U.S. Cl. ..... 399/223; 399/298; 430/42; 430/45

(58) Field of Search ..... 399/223, 226, 399/227, 231, 298, 321; 430/42, 45, 46, 109, 110, 111, 125, 126

(56) References Cited

U.S. PATENT DOCUMENTS

| | | | | |
|---|---|---|---|---|
| 5,256,507 A | * | 10/1993 | Aslam et al. | 430/42 |
| 5,344,732 A | * | 9/1994 | Chiba et al. | 430/42 |
| 5,707,771 A | | 1/1998 | Matsunaga | 430/110 |
| 5,753,399 A | | 5/1998 | Hayase et al. | 430/109 |
| 6,001,527 A | | 12/1999 | Ishihara et al. | 430/110 |
| 6,002,903 A | | 12/1999 | Hayase et al. | 399/279 |
| 6,013,402 A | * | 1/2000 | Kanbayashi et al. | 430/45 |
| 6,033,817 A | | 3/2000 | Yusa et al. | 430/106.6 |
| 6,051,350 A | | 4/2000 | Inaba et al. | 430/45 |

FOREIGN PATENT DOCUMENTS

| | | |
|---|---|---|
| JP | 63319037 | 12/1988 |
| JP | 01257857 | 10/1989 |
| JP | 06317928 | 11/1994 |
| JP | 9 258474 | 10/1997 |

* cited by examiner

*Primary Examiner*—Sophia S. Chen
*Assistant Examiner*—Hoan Tran
(74) *Attorney, Agent, or Firm*—Burns, Doane, Swecker & Mathis, LLP

(57) ABSTRACT

A developing system is provided for forming a full-color image, which includes (i) a first developing device which is equipped with a developer-supporting member having a mean crest distance (Sm) of 20–200 μm on its surface and satisfying the following relation:

0.5–30, (ii) a second developing device which is equipped with a developer-supporting member having a mean crest distance (Sm) of 20–200 μm on its surface and satisfying the following relation:

d4, Ra=0.5–3.0, wherein tan δ (50° C.) of the black toner is not more than 1.0, and a first ratio of tan δ and a first ratio tan 6 represented by (tan 8 (150° C.) of the first color toner (tan 8 (150° C.) of the black toner satisfies the following relation:

I the first ratio of tan 8s 1.35.

20 Claims, 8 Drawing Sheets

DEVELOPING SYSTEM FOR FORMING A FULL-COLOR IMAGE

This application is based on an application No. 034966/2000 filed in Japan, the contents of which are hereby incorporated by reference.

BACKGROUND OF THE INVENTION

1. Field of the Invention

The present invention relates to a developing system for forming a full-color image which is employed in a full-color image-forming apparatus wherein an electrophotography and an electrostatic printing are utilized.

2. Description of the Related Art

With the spread of a full-color development, the images wherein a full-color part and a black letter part coexist are in a fair way to a mainstream of the documents employed in an office. In recent years, many digital full-color machines have been proposed. The mainstream of the full-color machines is a machine wherein a full-color image is formed by superposing each color image of four kinds of color images (cyan, magenta, yellow and black images). Under the present situation, a percentage of an image-forming apparatus (copying machine or printer) wherein a monochromic mode and a full-color mode are united has been increased with a speeding up, said apparatus being referred to as monochrome/full-color united apparatus hereinafter.

In the case of the monochrome/full-color united apparatus, the same black toner is employed in the monochromic mode and full-color mode. In general, the black toner is prepared in such a way that a characteristic glossiness of the full-color image appears so as to achieve an excellent color reproducibility when it is used for forming the full-color image. For this reason, even if any of the monochromic mode and full-color mode is employed, a glossiness of letter parts becomes too high, and it is very difficult to read said letter.

Furthermore, the monochrome/full-color united apparatus has a problem that a speed of image formation in the monochromic mode is low. In general, the same developer-supporting member is employed in all developing devices (cyan developing device, magenta developing device, yellow developing device and black developing device). In the case where a speed of the developing system is increased, there is a problem that an unevenness of image concentration occurs when a black solid image is formed, since a followability (conveyability) of the black toner becomes worse, and the black toner cannot smoothly be conveyed.

On the other hand, two methods are known as a developing method. One is a two-component developing method wherein toner particles are electrified by friction between carrier particles and the toner particles. The others is a one-component developing method wherein the toner particles are electrified by passing through a clearance between the developer-supporting member and the developer-regulating member. With a digitization of the image-forming apparatuses, an opportunity to set the image-forming apparatuses by user's side (e.g. in the immediate vicinity of a personal computer) has been increased. From a viewpoint of a saving of spaces in offices, the one-component developing method are widely employed, since said method can be conducted by means of a miniaturized apparatus.

To say more precisely, one-component developer is passed through the clearance between the developer-supporting member and the developer-regulating member which is arranged in contact with said developer-supporting member to form a thin-layer of the toner on said developer-supporting member and to electrify the toner particles in one-component developing method, said electrified toner particles being conveyed to a developing region as they are in order to develop an electrostatic latent image formed on a supporting member for said latent image. However, in this one-component developing method wherein the toner particles are electrified by passing the developer through the clearance between the developer-supporting member and the developer-regulating member, the toner particles are subjected to a high stress at the time of passing through said clearance, and a problem has been arisen that a satisfactory developing cannot be carried out, said problem being attributable to the following phenomena: (i) The toner particles are adhered to the developer-regulating member to lower a function of said member to form the thin-layer of the toner, and a poor electrification of the toner is brought about. (ii) A filming caused by a fusion of the toner particles occurs on the developer-supporting member (e.g. sleeve and the like). (iii) A fogging occurs on a photosensitive member (supporting member for electrostatic latent image). In addition, when the image is repeatedly copied by means of the apparatus wherein the one-component developing method is adopted, the aforementioned problems become remarkable to cause another problem that it is difficult to keep a stable toner characteristic.

In order to solve these problems, a technique for sphering a toner shape has recently been developed. It is thinkable that by sphering the toner shape, a crushing degree of the toner is decreased to suppress an occurrence of components having smaller particle size, and a decrease of the filming on the sleeve and the like can be possible. To put it concretely, a wet preparation method of a spherical toner by a suspension polymerization or an emulsion polymerization (Japanese Patent Publication (KOKAI) No. 257857/1989) and a spherization technique of a toner by heat treatment of a pulverized toner (Japanese Patent Publication (KOKAI) Nos. 319037/1988 and 317928/1994) have been proposed.

However, the spherization of the toner shape brings about an unsatisfactory conveyance of the toner because a powder pressure of the toner is decreased at a contact area with the developer-regulating member and an insertion of the toner in the clearance between the developer-supporting member and the developer-regulating member becomes difficult. If the unsatisfactory conveyance of the toner occurs, an unevenness of image concentration will occur when the solid image is formed.

Although the present inventors have attempted to increase the conveyability of the toner by giving a roughness to the surface of the developer-supporting member, sufficient durability and electrification stability of the toner could not be obtained when the former spherized toner is employed. In particular, with an increase of a toner-conveying speed of the developer-supporting member to cope with a high-speed system, the toner filming on the surface of the developer-supporting member, the toner fogging on the photosensitive member and the toner adhesion to the developer-regulating member were remarkably occurred, and the durability and electrification stability of the toner were remarkably decreased.

SUMMARY OF THE INVENTION

The present invention has been made in view of the aforementioned situation. The object of the present invention is to provide a developing system for forming a full-color image, wherein (i) an easiness of reading the black letter part is kept by suppressing a glossiness of said letter part, (ii) a speed-up of the monochromic development and an excellent color reproducibility of the full-color development can be achieved, (iii) the occurrences of the toner filming on the developer-supporting member and the toner fogging on the photosensitive member can be prevented over a long period of time, (iv) the toner can satisfactorily be conveyed to the developing region, and (v) the toner adhesion to the developer-regulating member can be prevented.

The present invention relates to a developing system for forming a full-color image which comprises (i) a first developing device which is equipped with a developer-supporting member which carries one-component developing including a black toner and a regulating member which forms a thin layer of the black toner on the developer-supporting member, said developer-supporting member having a mean crest distance (Sm) of 20–200 μm on its surface and satisfying the following relation:

$$d_{50}/Ra=0.5–30$$

(wherein $d_{50}$ is a weight-average particle size (μm) of the black toner, and Ra is a surface roughness (μm) of the developer-supporting member), and (ii) a second developing device which is equipped with a developer-supporting member which carries one-component developer including a first color toner and a regulating member which forms a thin layer of the first color toner on the developer-supporting member, said developer-supporting member having a mean crest distance (Sm) of 20–200 μm on its surface and satisfying the following relation:

$$d_{50}/Ra=0.5–3.0$$

(wherein $d_{50}$ is a weight-average particle size (μm) of the first color toner, and Ra is a surface roughness (μm) of the developer-supporting member), wherein tan δ (150° C.) of the black toner is not more than 1.0, and a first ratio of tan δ represented by (tan δ (150° C.) of the first color toner/tan δ (150° C.) of the black toner) satisfies the following relation:

$$1.1 \leqq \text{the first ratio of tan } \delta \leqq 1.35.$$

DETAILED DESCRIPTION OF THE INVENTION

Figure 1:
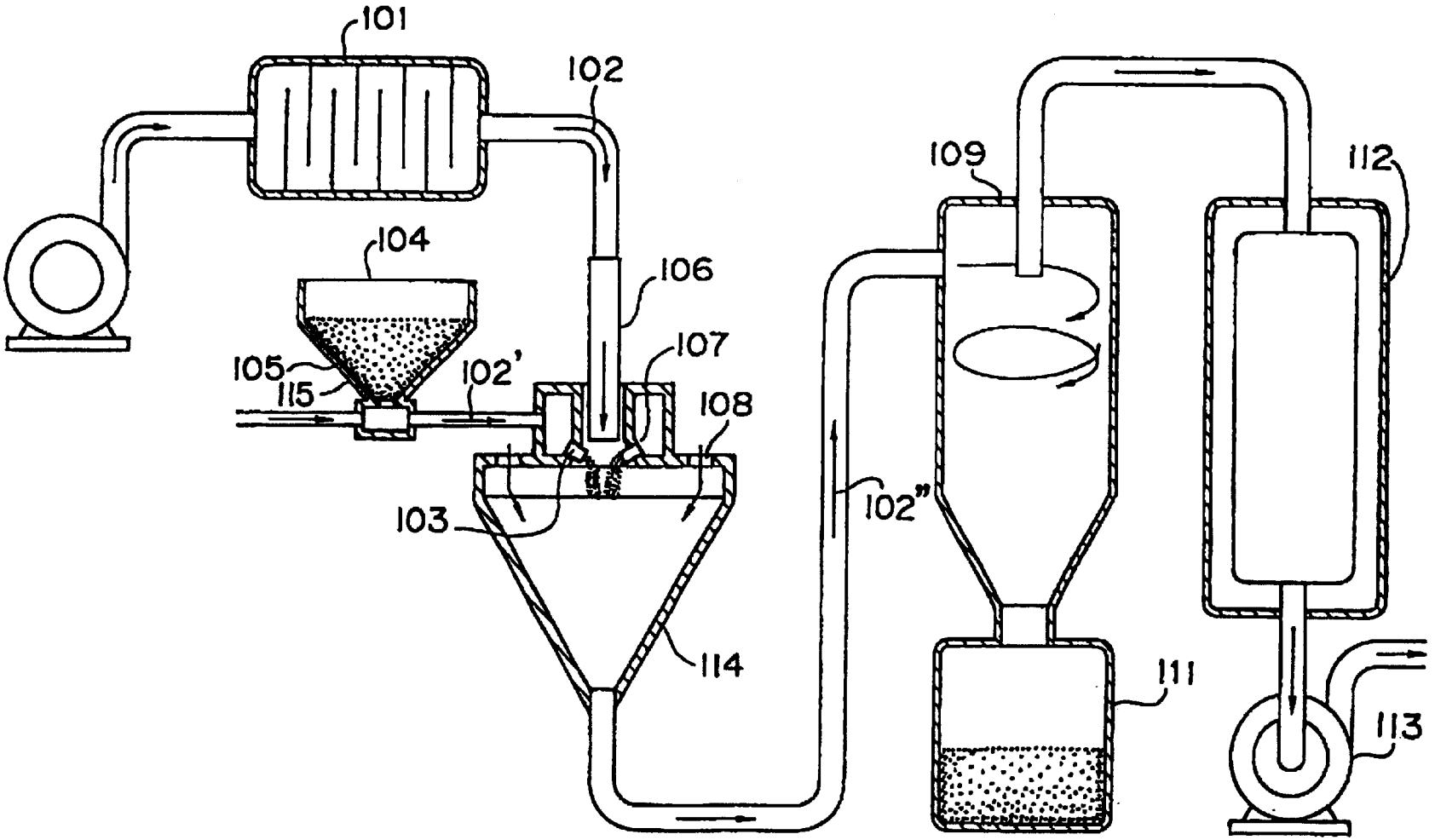
FIG. 1 is a schematic construction of an apparatus for instantaneously heat-treating the toner.

First of all, one-component developers employed in the developing system according to the present invention will be explained. The one-component developers used in the present invention include nonmagnetic or magnetic toners and are prepared independently as each monochromic developer. For example, in the case where the full-color image formed of cyan color, magenta color, yellow color and black color are formed, one-component cyan developer consisting of a cyan toner, one-component magenta developer consisting of a magenta toner, one-component yellow developer consisting of a yellow toner and one-component black developer consisting of a black toner are employed. These one-component developer may independently be nonmagnetic or magnetic. In the present specification, "full-color" means all the colors including black color, and "color toner" means all the colored toners excluding the black toner (for example, in the case where the cyan toner, magenta toner, yellow toner and black toner are used, the color toner means the cyan toner, magenta toner and yellow toner).

Each color toner and the black toner used in the present invention satisfy the following relations (1) and (2), i.e. each color toner satisfies the relation (1) in reference to the black toner, and the black toner satisfies the relation (2).

$$1.1 \leqq \text{Tan } \delta \text{ ratio} \leqq 1.35 \quad (1)$$

wherein $$\text{Tan}\delta \text{ ratio} = \frac{\text{Tan}\delta \text{ of color toner measured at } 150° \text{ C./1Hz}}{\text{Tan}\delta \text{ of the black toner measured at } 150° \text{ C./1Hz}}$$

$$\text{Tan } \delta \text{ of the black toner measured at } 150° \text{ C./1 Hz} \leqq 1.0 \quad (2)$$

Preferably, each color toner and the black toner satisfy the following relations (1.1) and (2.1).

$$1.2 \leqq \text{Tan } \delta \text{ ratio} \leqq 1.30 \quad (1.1)$$

wherein Tan δ ratio has the same meaning as in the relation (1).

$$0.85 \leqq \text{Tan } \delta \text{ of the black toner measured at } 150° \text{ C./1 Hz} \leqq 1.0 \quad (2.1)$$

It is thinkable that a color reproducibility (glossiness) of a full-color part at the time of full-color development can be increased by employing each color toner and the black toner which satisfy the aforementioned relations (1) and (2), while an easiness of reading can be kept by a suppression of glossiness of the black letter part. A fact that an image has a glossiness means that a surface of toner layer on an image-supporting member is microly smooth. Toner particles on the image-supporting member are fixed on a paper by heat and pressure during a fixing process. It is thinkable that the surface of toner layer which becomes microly smooth exhibits a high glossiness at this point of time, and a surface of toner layer which becomes uneven exhibits a relatively low glossiness. In the case where the toner is more closely allied to a viscous material (i.e. a value of Tan δ is high) at the time of fixing, the surface of toner layer becomes smooth and exhibits a fairly high glossiness, since the toner is sufficiently deformed by the pressure and heat between fixing rollers. On the contrary, in the case where the toner is more closely allied to an elastic material (i.e. a value of Tan δ is low) at the time of fixing, it is thinkable that the toner loses its glossiness, since a deformed part of the toner which is deformed by the pressure and heat between the fixing rollers restores to make the surface of toner layer uneven and a smooth surface cannot be formed. When the aforesaid Tan δ ratio is less than 1.1, the color reproducibility becomes worse, since a glossiness of full-color part becomes closely monochromic and becomes too low. When the aforesaid Tan δ ratio is more than 1.35, a glossiness difference between the full-color part and letter part becomes large, and said difference brings about a noise to lower an image quality. Furthermore, when Tan δ of the black toner is more than 1.0, a glossiness of the letter part becomes too high, and it is difficult to read said letter.

In the present specification, a value represented by the following equation (5) was employed as the aforesaid Tan δ of the toner, said value being measured by means of Dyn Alyser DAR-100 (manufactured by REOLOGICA Co.). To say more precisely, a temperature dependence of Tan δ of the toner is measured under the following conditions, and Tan δ of the toner at 150° C. is determined from the measured results:

Frequency; 1 Hz

Strain percentage; 5% (automatic)

Rate of temperature rise; 2° C./min

When the value of Tan δ is high, viscouse components increase. On the contrary, when the value of Tan δ is low, elastic components increase.

$$\mathrm{Tan}\delta = \frac{\text{loss elastic modulus } (G'')}{\text{storage elastic modulus } (G')} \tag{5}$$

It is possible to adjust Tan δ of the color toner and black toner by suitably selecting a kind of a binder resin of each toner.

In the developing system according to the present invention, each toner is conveyed to a developing region as a toner thin layer by means of the developer-supporting member which has a mean crest distance (Sm) of 20–200 μm, preferably 40–100 μm, and satisfies the following relation:

$$\frac{d_{50}}{Ra} = 0.5\text{–}3.0 \text{ (preferably 0.7–2.5, more preferably 1.3–2.4)}$$

wherein $d_{50}$ (μm) is the weight-average particle size of each toner, and Ra (μm) is the surface roughness of the developer-supporting member. In other words, the weight-average particle size of each toner and the surface roughness of the developer-supporting member which conveys said toner satisfy the aforesaid ratio of $d_{50}$/Ra, and the developer-supporting member has the mean crest distance within the aforesaid range. It is thinkable that by defining the ratio of $d_{50}$/Ra and Sm within the aforementioned ranges, the occurrences of toner filming on the surface of the developer-supporting member and toner fogging on the photosensitive member can be prevented when the system speed is set to a relatively high value, while a satisfactory conveyability of the toner is kept. When the ratio of $d_{50}$/Ra concerning any toner is less than 0.5 or the value of Sm of any developer-supporting member used in the developing system of the present invention is less than 20 μm, an unsatisfactory electrification of the toner caused by an excessive conveyance of the toner will occur, and the toner fogging on the photosensitive member will occur. On the other hand, when the ratio of $d_{50}$/Ra concerning any toner is more than 3.0 or the value of Sm of any developer-supporting member is more than 200 μm, amounts of the developer supplied to the developer-supporting member become insufficient, and unsatisfactory conveyance of the toner will occur, and an unevenness of image concentration will occur at the time of forming a solid image.

In the present specification, the weight-average particle size of the toner ($d_{50}$) means the particle size which corresponds to 50% of relative weight distribution classified by particle size, and the values of $d_{50}$ measured by means of Coulter Multisizer (manufactured by Coulter Counter Co.) are employed. However, the value of $d_{50}$ may be measured by means of any apparatus wherein the same measuring principle and method as those of the above apparatus are adopted, and it is not necessarily to measure said value by means of the above apparatus.

The value of $d_{50}$ of the toner is controllable by suitably selecting a pulverizing condition, a classifying condition and/or an aftermentioned instantaneous heating condition at the time of preparing the toner.

Furthermore, the surface roughness of the developer-supporting member (Ra) and the mean crest distance (Sm) mean a mean roughness of center line according to JIS B 0601 and a mean distance of concave and convex according to JIS 0468 respectively. Therefore, Ra and Sm may be measured by means of any apparatus by which these values based on the above definitions of JIS can be measured. The surface of the developer-supporting member to be measured is an interface between said developer-supporting member and the toner (toner thin layer-forming surface).

The values of Ra and Sm are controllable by roughening previously an inner surface of a mold which is employed for preparing a member which constitutes the surface of the developer-supporting member or by adding the publicly known inorganic fine particles to the member which constitutes the surface of the developer-supporting member.

Although each toner (color toner and black toner) used in the present invention may independently be nonmagnetic or magnetic toner, it is preferable that all the toners are nonmagnetic toners or all the color toners are nonmagnetic toners and the black toner is magnetic toner.

In the case where the toners used in the present invention are nonmagnetic toners, it is preferable that the nonmagnetic toners have a mean roundness of not less than 0.950 (preferably not less than 0.960), a standard deviation of the roundness of not more than 0.040 (preferably not more than 0.035) and $D/d_{50}$ of not less than 0.40 (preferably 0.40–0.80, more preferably 0.45–0.70), wherein $D=6/(\rho \cdot S)$(wherein ρ is a true density ($g/cm^3$) of the toner, and S is BET specific surface area ($m^2/g$) of the toner). An additional control of the mean roundness of the toner, the standard deviation of the roundness and $D/d_{50}$ provides the new effects that (i) an easiness of reading of the black letter part, a speed up of the monochromic development and a color reproducibility of full-color development are further increased, (ii) occurrences of toner filming on the developer-supporting member and toner fogging on the photosensitive member can effectively be prevented and (iii) an adhesion of the toner on the developer-regulating member can be prevented. It is thinkable that these new effects are brought about by an effective reduction of the stress of the developer-regulating member on the toner.

The mean roundness is a mean value of the values calculated by the undermentioned equation (6). The mean roundness provides an index that correctly reflects shapes of the toner particles, i.e. concave and convex states of the particle surfaces, since said value is determined by "circumferential length of a circle which is equal to a projection area of a particle" and "circumferential length of a projection image of a particle". The more the value is close to 1, the more the particle is close to a true circle. Moreover, a reliability of the mean roundness used in the present invention is very high, since said mean roundness is a value that is obtained as an average value of the mean roundness on three thousands of toner particles. In the present specification, the values which were obtained in an aqueous dispersion system by means of a flow-type particle image analyzer EPIA-1000 or EPIA-2000 (manufactured by Toa Iyou Denshi K.K.) are used as the values of "circumferential length of a circle whose area is equal to a projection area of a particle" and "circumferential length of a projection image of a particle". However, it is not necessarily to measure these values by using said analyzer. These values may be measured by means of any apparatus by which said values based on the following equation (6) can be obtained in principle.

$$\text{Mean roundness} = (\text{circumferential length of a circle whose area is equal to a projection area of a particle}) / (\text{circumferential length of a projection image of a particle}) \quad (6)$$

The standard deviation of the roundness means a standard deviation in a roundness distribution, and said standard deviation can be obtained together with the mean roundness by means of the aforementioned flow-type particle image analyzer. The lower the standard deviation is, the more uniform a shape of toner particles is.

The mean roundness of the toner and the standard deviation of the roundness are controllable by suitably selecting a pulverizing condition, a classifying condition and an aftermentioned instantaneous heating condition at the time of preparing the toners.

The value of $D/d_{50}$ indicates a surface shapability of toner particles, and is an index which indicates an existence of pores on the surface or in the inside of the toner particles. It is thinkable that an occurrence of toner fogging on the photosensitive member can effectively be prevented, and an adhesion of the toners on the developer-regulating member can be prevented in the case where the toners having the aforesaid values of $D/d_{50}$ are particularly employed, since said toners do not bring about harmful phenomena that (i) the toners are cleaved around the pore parts as a center, (ii) the concave parts are filled up with a fluidizing agent (e.g. silica and the like) which is added to the toners as an external additive, and (iii) the convex parts are scraped to generate fine powder. In the case where the nonmagnetic toners are employed, it is preferable to select $D/d_{50}$ of not more than 0.80 from a viewpoint of increasing an electrification of the toners by a formation of suitable convex parts on the toner surface, said formation being caused by an external addition of an inorganic fine particles to the toner particles.

The $d_{50}$ indicates, as aforementioned, the weight-average particle size of the toner, and the D is represented by the following equation (7):

$$D=6/(\rho \cdot S) \quad (7)$$

wherein ρ is a true density ($g/cm^3$) of the toner, and S is BET specific surface area ($m^2/g$) of the toner. In other words, D indicates a reduced particle size (μm) calculated from BET specific surface area on the assumption that a shape of the toner is a sphere.

Although the values which were measured by means of Flow Sorb 2300-type (manufactured by Shimazu Seisakusyo K.K.) are used as BET specific surface area in the present specification, it is not necessarily to measure said specific surface area by using said apparatus. Any apparatus may be employed provided that said specific surface area is determined by the same measuring principle and method.

Although the values which were measured by means of an air-relative specific gravity hydrometer (manufactured by Beckman Co.) are used as a true density (ρ) in the present specification, it is not necessarily to measure the true density by using said hydrometer. Any device may be employed provided that said true density is determined by the same measuring principle and method.

The value of $D/d_{50}$ of the toner can be controlled by an adjustment of S and ρ which is caused by a suitable selection of a pulverizing condition, a classifying condition and the aftermentioned instantaneous heating condition at the time of preparing the toner, and/or an aforementioned adjustment of the value of $d_{50}$.

In the case where the toners used in the present invention are magnetic toners, it is preferable that said magnetic toners have the mean roundness of not less than 0.950 (preferably not less than 0.960), the standard deviation of the roundness of not more than 0.040 (preferably not more than 0.035) and $D/d_{50}$ of not less than 0.20 (preferably 0.20–0.55, more preferably 0.25–0.50), wherein $D=6/(\rho \cdot S)$ (wherein ρ is a true density ($g/cm^3$) of the toner, and S is BET specific surface area ($m^2/g$) of the toner). An additional control of the mean roundness, the standard deviation of the roundness and $D/d_{50}$ provides the new effects that (i) an easiness of reading of the black letter part, a speed up of the monochromic development and a color reproducibility of full-color development are further increased, (ii) occurrences of toner filming on the developer-supporting member and toner fogging on the photosensitive member can effectively be prevented and (iii) an adhesion of the toner on the developer-regulating member can be prevented. It is thinkable that these new effects are brought about by an effective reduction of the stress of the developer-regulating member on the toner. In the case where the magnetic toners are employed, it is preferable to select $D/d_{50}$ of not more than 0.55 from a viewpoint of increasing an electrification of the toners by a formation of suitable convex parts on the toner surface, said formation being caused by an external addition of an inorganic fine particles to the toner particles.

Detailed explanations concerning the mean roundness, the standard deviation of the roundness, $D/d_{50}$, S and ρ are omitted, since they have the same meanings as those mentioned above in connection with the case where the toners are nonmagnetic toners.

As regards the ratio ($d_{50}$/Ra) of a weight-average particle size of the toner ($d_{50}$)(μm) to a surface roughness of the developer-supporting member (Ra)(μm) and a mean crest distance of the developer-supporting member (Sm)(μm), it is preferable that each color toner and the black toner are conveyed to the developing region as a toner thin layer by the developer-supporting member which satisfies the following relations (3) and (4) whether each toner is nonmagnetic or magnetic:

$$(d_{50} \text{ of a color toner})/(Ra \text{ of a developer-supporting member which conveys a color toner}) > (d_{50} \text{ of a black toner})/(Ra \text{ of a developer-supporting member which conveys the black toner}) \quad (3)$$

$$(Sm \text{ of a developer-supporting member which conveys a color toner}) < (Sm \text{ of a developer-supporting member which conveys the black toner}) \quad (4)$$

Concerning all the toners used in the present invention, a speed up of the monochromic development (i.e. a speed up of an image formation in the monochromic mode) can effectively be achieved by employing each toner and the developer-supporting member which satisfies the aforementioned relations. The speed of image formation in the monochromic mode, i.e. the system speed can be increased, while the objects of the present invention can be achieved.

The toners used in the developing system according to the present invention may be prepared by any methods, provided that the toners having the aforementioned properties can be obtained. For example, publicly known preparation methods of toners, such as dry processes (e.g. a grinding method, and the like) and wet process (e.g. an emulsion dispersion method, an emulsion polymerization method, a suspension polymerization method and the like) can be adopted. From a viewpoint of an easy production, it is preferable to adopt the grinding method in the present invention.

In the case where the toners which can be used in the present invention are prepared by adopting the grinding method, a binder resin, a colorant and other desired additives are mixed, kneaded, ground and then classified according to the former method. By subjecting the toner particles prepared by the aforesaid method to the instantaneous heating treatment, the aforementioned toners used in the present invention can more readily be obtained. It is preferable to adjust a volume-average particle size of the toners to 4–10 μm, preferably 5–9 μm. A particle size distribution of the toners is hardly changed before and after the instantaneous heating treatment.

Although the binder resin for the toners used in the present invention are not particularly restricted, styrene resins, acrylic resins, styrene-acrylic resins, polyamide resins, polyester resins, polyurethane resins, epoxy resins and other publicly known resins are exemplified. These binder resins may be used independently or as a mixture, and they may be used by suitably selecting the preferable resins so as to meet a specific purpose. For example, it is preferable to use polyester resins for negative-chargeable toners or color toners, and it is preferable to employ polyester resins and/or styrene-acrylic resins for the black toner. In the present invention, it is preferable to employ the resins which have a glass transition temperature (Tg) of 50–75° C., a softening point (Tm) of 80–160° C., a number-average molecular weight (Mn) of 1000–30000 and a ratio of weight-average molecular weight to number-average molecular weight (Mw/Mn) of 2–100.

Particularly, it is desirable for color toners to employ the resins which have a glass transition temperature of 50–75° C., a softening point of 80–120° C., a number-average molecular weight of 2000–30000 and the ratio (Mw/Mn) of 2–20.

Moreover, it is desirable for the black toner including a magnetic toner to employ the binder resin which contains of a first resin having a softening point of 80–125° C. and a glass transition temperature of 50–75° C. and a second resin having a softening point of 125–160° C. and a glass transition temperature of 50–75° C.

As a binder resin component for the toners, it is more preferable to use the polyester resins which have the aforesaid properties as well as an acid value of 2–50 KOHmg/g, preferably 3–30 KOHmg/g. By using the polyester resins having said acid value, dispersibilities of various kinds of pigments including carbon black and charge-control agents can be increased, and the toners having a sufficient charging amount can be prepared. When the acid value is less than 2 KOHmg/g, these effects becomes lower. If the acid value is more than 50 KOHmg/g, a stability of chargeability for a change of environmental conditions, particularly, a change of humidity is deteriorated.

As the polyester resins, a polyester resin which is prepared by polycondensing a polyhydric alcohol and a polycarboxylic acid is usable.

Among polyhydric alcohol components, examples of dihydric alcohol components include: bisphenol A-alkylene oxide adducts, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, and anhydrides or lower alkyl esters of these acids.

Examples of tri- or higher polycarboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol dimer acid, anhydrides and lower alkyl esters of these acids.

In the present invention, with respect to the polyester resin, a monomeric material for a polyester resin, a monomeric material for a vinyl resin and a monomer that reacts with both of these monomeric materials are used, and a polycondensating reaction for obtaining the polyester resin and a radical polymerization reaction for obtaining the vinyl resin are carried out in parallel in the same container; and resins thus obtained may be preferably used. The monomer that reacts with both of these monomeric materials is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the monomeric materials for polyester resins include the above-mentioned polyhydric alcohol components and polycarboxylic acid components.

Examples of the monomeric materials for vinyl resins include: styrene or styrene derivatives, such as o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinyl acetate, vinyl benzoate, vinyl methyl ethyl ketone, vinyl hexyl ketone, vinyl methyl ether, vinyl ethyl ether, and vinyl isobutyl ether. Examples of polymerization initiators used when the monomeric materials for vinyl resins are polymerized include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methyl ethyl ketone peroxide, isopropylperoxycarbonate and lauroyl peroxide.

Moreover, vinyl resins prepared by polymerizing the aforementioned monomeric materials can be used as a binder resin component for the toners. Among the vinyl resins, styrene-acrylic resins are preferable, said styrene-acrylic resins being obtained by copolymerizing styrene or styrene derivatives with alkyl esters of methacrylic acid and/or alkyl esters of acrylic acid.

The publicly known pigments and dyes may be employed as a colorant for the color toners. The following pigments and dyes are exemplified: carbon black, aniline blue, chalcoyl chrome yellow, ultramarine blue, Du Point oil red, quinoline yellow, methylene blue chloride, copper phthalocyanine blue, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3, and the like. A magnetic material can be substituted for a part or the whole of the colorant when various kinds of carbon blacks, active carbon and titanium black are added to the black toner. Fine particles of the publicly known magnetic materials such as ferrite, magnetite, iron and the like can be used as such a magnetic material. The preferable mean particle size of the magnetic particles is 1 μm or less, particularly 0.5 μm or less from the viewpoint of their dispersibility at the time of preparing the black toner. A suitable amount of addition of the colorant is 1–10 parts by weight relative to 100 parts by weight of the binder resin.

In the present invention, although the aforementioned magnetic materials are not hindered from adding to the color toners, it is an ordinary manner to add said magnetic materials to the black toner from a viewpoint of a colorability of said magnetic materials. The magnetic toners used in the present invention means the toners which comprise the aforementioned magnetic material in such an extent that they can be conveyed to the developing region as a toner thin layer, while they are adhered on the developer-supporting member by a magnetic force. The nonmagnetic toners means the toners other than the aforesaid magnetic toners.

In the case where the magnetic toners are prepared, a suitable amount of the magnetic materials to be added to the binder resin is 5–60 parts by weight relative to 100 parts by weight of the binder resin.

As the other additives which constitute the toners used in the present invention, for example, a wax, a charge-control agent and the like may be employed.

A wax may be added to the toner used in the present invention in order to improve the characteristics, such as an offset resistance, a smear phenomenon and the like. The following waxes are exemplified: polyethylene wax, polypropylene wax, carnauba wax, rice wax, sasol wax, montan ester wax, Fischer-Tropsch wax and the like. In the case where the wax is added to the toner, it is preferable to add 0.5–5 parts by weight of the wax relative to 100 parts by weight of the binder resin from the viewpoint of obtaining the addition effect of the wax without causing the problems, such as a filming and the like. It is preferable to add polypropylene wax to the toner from the viewpoint of an increase of the offset resistance. It is preferable to add polyethylene wax to the toner from the viewpoint of improving the smear phenomenon wherein the deteriorations of the image quality, such as a blot and a stain of the images and the like which are caused by the rubbing of the images with the roller at the time of automatically sending a manuscript or at the time of sending the paper whose one side has already been imaged in case of copying both sides of a paper. From the viewpoint of the aforesaid reasons, particularly preferred polypropylene wax has a melt viscosity of 50–300 cps/160° C., a softening point of 130–160° C. and an acid value of 1–20 KOHmg/g, and particularly preferred polyethylene wax has a melt viscosity of 1000–8000 cps/160° C., a softening point of 130–150° C. In other words, the polypropylene wax having the aforesaid melt viscosity, softening point and acid value exhibits an excellent dispersibility to the aforesaid binder resin, and achieves the increase of offset resistance without bringing about the problem caused by the liberated wax. It is preferable to use an oxidation type wax when the polyester resin in particular is employed as the binder resin. The oxidation type polyolefin waxes, carnauba wax, montan wax, rice wax, Fischer-Tropsch wax and the like are exemplified as the oxidation type wax.

With respect to polypropylene waxes which are polyolefin waxes, low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, Viscol 200TS (softening point 140° C., acid value 3.5), Viscol 100TS (softening point 140° C., acid value 3.5), Viscol 110TS (softening point 140° C., acid value 3.5), each of which is made by Sanyo Kasei Kogyo K.K., etc., are commercially available.

With respect to oxidized-type polyethylene, commercially available products are: San Wax E300 (softening point 103.5° C., acid value 22) and San Wax E250P (softening point 103.5° C., acid value 19.5), made by Sanyo Kasei Kogyo K.K.; Hi-Wax 4053E (softening point 145° C., acid value 25), 405MP (softening point 128° C., acid value 1.0), 310MP (softening point 122° C., acid value 1.0), 320MP (softening point 114° C., acid value 1.0), 210MP(softening point 118° C., acid value 1.0), 220MP(softening point 113° C., acid value 1.0), 4051E(softening point 120° C., acid value 12), 4052E(softening point 115° C., acid value 20), 4202E (softening point 107° C., acid value 17) and 2203A (softening point 111° C., acid value 30), made by Mitsui Sekiyukagaku K.K., etc.

When carnauba wax is used, the ones of fine crystal particles are preferably used with their acid value preferably in the range of 0.5 to 10 KOHmg/g, preferably 1 to 6 KOHmg/g.

Montan waxes generally refer to montan ester waxes refined from minerals, being in the form of fine crystals as well as carnauba wax; the acid value thereof is preferably in the range of 1 to 20, and more preferably, 3 to 15.

Rice wax is obtained by air-oxidizing rice bran wax, and its acid value being preferably in the range of 5 to 30 KOHmg/g.

Fischer-Tropsch wax is a wax that is produced as a by-product when synthetic oil is produced from coal according to the hydrocarbon-synthesizing method. Such a wax, for example, is available as trade name "sazol wax" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among sazol waxes, those of oxidized type having an acid value of 3 to 30 KOHmg/g (trade name: sazol wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

For example, the following compounds may be added as the charge-control agent: a fluorine surface-active agent, a metal-containing dye such as a metal complex of salicylic acid and an azo-series metal compound, a high molecular acid such as a copolymer containing maleic acid as a monomer component, a quaternary ammonium salt, an azine dye such as nigrosine, carbon black, etc. A suitable amount of the charge-control agent is 0.5–5 parts by weight relative to 100 parts by weight of the binder resins.

In the toner of the present invention, it is preferably to add various organic/inorganic fine particles as a fluidity-adjusting agent (a fluidizing agent) before a surface-modifying process and/or after a toner-particle preparation. Examples of the inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles such as silica, titanium oxide, alumina and zinc oxide are treated by a known method with a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also works as a cleaning-assist agent.

Inorganic fine particles, such as titanate metal salts, having a comparatively large particle size, and various organic fine particles may be, or may not be subjected to a hydrophobicizing treatment.

Addition amounts of these fluidizing agents before the instantaneous heating treatment are 0.1–6 parts by weight, preferably 0.5–3 parts by weight relative to 100 parts by weight of the toner particles. Moreover, external addition amounts of these fluidizing agents are 0.05–5 parts by weight, preferably 0.3–2 parts by weight relative to 100 parts by weight of the toner particles. It is preferable to use these fluidizing agents in such a manner that their addition amounts are suitably adjusted before and after the instantaneous heating treatment.

At the time of preparing the aforementioned toners, the classifying process may be carried out after the instantaneous heating treatment in the present invention. It is preferable to use a granulator which allows the pulverized particles to have a spherical shape as a pulverizer used in the pulverizing process. The instantaneous heating treatment, which is to be carried out successively, can be controlled more easily. Examples of such a device include an Inomizer System (made by Hosokawa Micron K.K.), a Criptron System (made by Kawasaki Jyukogyo K.K.), etc. As a classifier used in the classifying process, it is preferable to use such a classifier as to allow the processed particles to have a spherical shape. This makes it easier to control the degree of roundness, etc. Examples of such a classifier include a Teeplex Classifier (made by Hosokawa Micron K.K.).

The instantaneous heating treatment of the present invention may be carried out in combination with various processes in surface-modifying devices for various developers. Examples of these surface-modifying devices include surface-modifying devices using the high-speed gas-flow impact method, such as Hybridization System (made by Narakikai Seisakusho K.K.), a Criptron Cosmos System (made by Kawasaki Jyukogyo K.K.) and an Inomizer System (made by Hosokawa Micron K.K.), surface-modifying devices using the dry mechanochemical method, such as a Mechanofusion System (made by Hosokawa Micron K.K.) and a Mechanomill (made by Okadaseikou K.K.), and surface-modifying devices in which the wet coating method is applied, such as a Dispacoat (made by Nisshin Engineering K.K.) and Coatmizer (made by Freund Sangyo K.K.). And these devices may be used appropriately in a combined manner.

In the present invention, the instantaneous heating treatment controls the toner particles obtained through the pulverizing method so as to have a uniform spherical shape, reduces fine pores appearing on the surface of the toner, and increases smoothness. This makes it possible to provide a toner which is superior in uniformity in charging and in image-forming performance, eliminates phenomena such as selective developing in which toner having specific particle size, shape and ingredient in the developer and a specific quantity of charge is first consumed selectively, and achieves a stable image-forming performance for a long time.

Even when applied as a small particle size toner which contains as its main component a low softening point binder resin that is suitable for a high image-quality, low consumption (coloring material is highly-filled) and a low-energy fixing system, those properties being highly demanded in recent years, and which contains a coloring material at high filling-rate, the toners used in the present invention exhibit appropriate adhesive properties to the developer-supporting member (developing sleeves), the photosensitive member and the transferring members as well as superior moving properties. Therefore, a fluidity of the toners is excellent, and a uniformity of an electrification of the toners is improved, and a stable durability is ensured for a long time.

The instantaneous heating treatment used in the present invention is carried out by spraying and dispersing toner particles into a hot air by using compressed air. The developer is surface-modified by heat. A high degree of sphericity and homogeneity that have not been achieved by conventional methods can be achieved.

Figure 2:
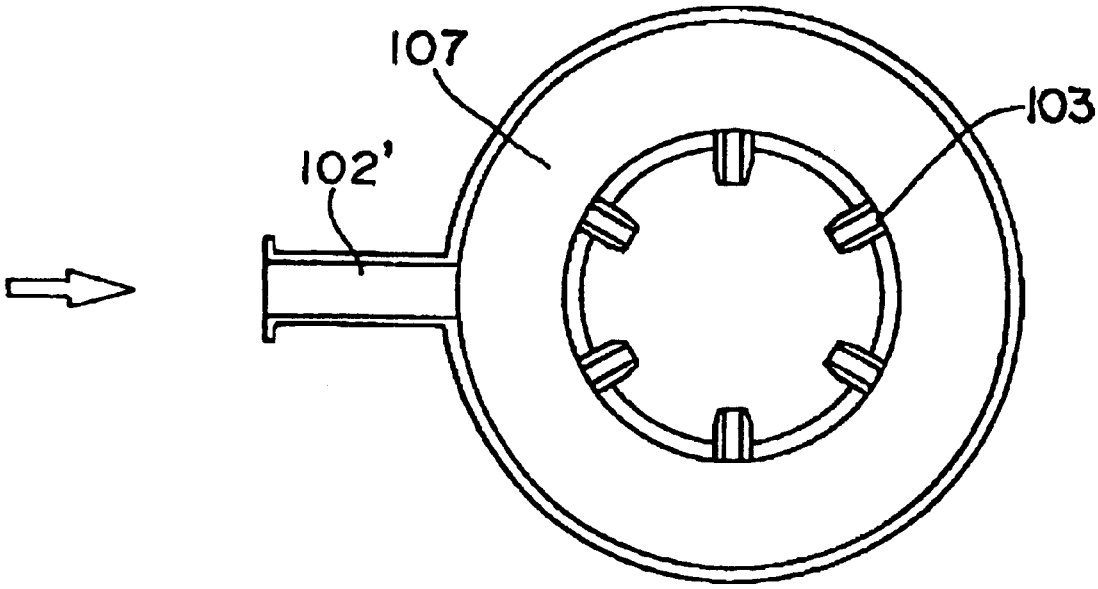
FIG. 2 is a schematic horizontal sectional view of a sample-injecting chamber of the apparatus shown in FIG. 1.

Referring to schematic views of FIG. 1 and FIG. 2, the following description will explain the construction of a device that carries out the instantaneous heating treatment.

As illustrated in FIG. 1, high-temperature, high-pressure air (hot air) prepared in a hot-air generating device 101 is ejected from a hot-air jetting nozzle 106 through an induction pipe 102. Toner particles 105 are transported by a predetermined amount of pressurized air from a quantitative supplying device 104 through an induction pipe 102', and fed to a sample-ejecting chamber 107 installed around the hot-air ejecting nozzle 106.

As illustrated in FIG. 2, the sample-ejecting chamber 107 has a hollow doughnut shape, and a plurality of sample-ejecting nozzles 103 are placed on its inside wall with the same intervals. The toner particles which have sent to the sample-ejecting chamber 107 are allowed to spread inside the ejecting chamber 107 in a uniformly dispersed state, and discharged through the sample-ejecting nozzles 103 into the hot air flow by the pressure of air successively sent thereto.

It is preferable to provide a predetermined tilt to the sample-ejecting nozzles 103 so as not to allow the discharging flow from each sample-ejecting nozzle 103 to cross the hot air flow. More specifically, the ejection is preferably made so that the toner-ejecting flow runs along the hot air flow to a certain extent. An angle formed by the toner ejecting flow and the direction of the central flow of the hot air flow is preferably set in the range of 20 to 40°, preferably 25 to 35°. The angle which is wider than 40° causes the toner ejecting flow to cross the hot air flow, resulting in collision with toner particles discharged from other nozzles and the subsequent aggregation of the toner particles. The angle which is narrower than 20° leaves some toner particles not being taken in the hot air flow, resulting in irregularity in the toner particle shape.

A plurality of the sample-ejecting nozzles 103, preferably at least not less than 3, more preferably not less than 4 are required. The use of a plurality of the sample-ejecting nozzles makes it possible to uniformly disperse the toner particles into the hot air flow, and to ensure a heating treatment for each of the toner particles. With respect to the ejected state from the sample-ejected nozzle, it is desirable that the toner particles are widely scattered at the time of ejection and dispersed to the entire hot air flow without collision with other toner particles.

The toner particles that have been ejected are allowed to contact with the high-temperature hot air instantaneously, and subjected to a heating treatment uniformly. "Instantaneously" refers to a time period during which a required toner-particle improvement (heating treatment) has been achieved without causing aggregation between the toner particles; and although it depends on the processing temperature and the density of toner particles in the hot air flow, this time period is normally set at not more than 2 seconds, preferably not more than 1 second. This instantaneous time period is represented as a residence time of toner particles from the time when the toner particles are ejected from the sample-ejecting nozzles to the time when they are transported into the induction pipe 102". The residence time exceeding 2 seconds is likely to cause bonding of particles.

The toner particles, which have been instantaneously heated, are cooled off by a cold air flow introduced from a cooling-air induction section 108, and collected into a cyclone 109 through the induction pipe 102" without adhering to the device walls and causing aggregation between particles, and then stored in a product tank 111. The carrier air from which the toner particles have been removed is allowed to pass through a bug filter 112 by which fine powder is removed therefrom, and released into the air through a blower 113. The cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the induction pipe 102' by the pressurized air. Although it also depends on other conditions, the amount of dispersing air is preferably suppressed during the heating treatment, since a dispersing state of toner particles are improved and stabilized.

The dispersion density refers to a dispersion density of toner particles in a heating treatment area (more specifically, a nozzle-jetting area). A preferable dispersion density varies depending on the specific gravity of toner particles; and the value obtained by dividing the dispersion density by the specific gravity of toner particles is preferably set in the range of 50 to 300 $g/m^3$, preferably 50 to 200 $g/m^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable from the viewpoint of device mechanism to supply an air flow in a stable laminar-flow state by using a stabilizer, etc. In the case of a toner containing a binder resin having a sharp molecular-weight distribution, for example, a binder resin having a ratio of weight-average molecular weight/number-average molecular weight of 2 to 20, it is preferable to carry out the heating treatment in a peak-temperature range between the glass transition point of the binder resin of +100° C. and that of +300° C. It is more preferable to carry it out in a peak-temperature range between the glass transition point of the binder resin of +120° C. and that of +250° C. The peak temperature range refers to a maximum temperature in the area in which the toner contacts with the hot air.

In the case of a toner containing a binder resin having a relatively wide molecular-weight distribution, for example, a binder resin having a ratio of weight-average molecular weight/number-average molecular weight of 30 to 100, it is preferable to carry out the heating treatment in a peak-temperature range between the glass transition point of the binder resin of +100° C. and that of +300° C. It is more preferable to carry it out in a peak-temperature range between the glass transition point of the binder resin of +150° C. and that of +280° C. The reason for this is that, in order to improve the shape and surface homogeneity of the toner, it is necessary to apply a high processing temperature so that even the high molecular portion of the binder resin can be modified. However, the setting of the high processing temperature, in contrast, tends to produce bonded particles; therefore, tuning of conditions may be required. For example, an amount of a fluidizing agent prior to the heating treatment has to be set higher, or the dispersion density is set lower at the time of the treatment, etc.

When wax is added to the toner particles, particles are more likely to bond. For this reason, tuning of conditions may be required. For example, an amount of a fluidizing agent (especially, fluidizing agent having a large particle size) prior to the heating treatment is set higher, and the dispersion density is set lower at the time of the treatment, etc. These adjustments are significant to obtain uniform toner particles with shape-irregularity suppressed. These operations are particularly important when a binder resin having a relatively wide molecular weight distribution is used or when the processing temperature is set to a high level in order to heighten the degree of sphericity.

The cooling air temperature refers to a temperature of cold air introduced from the cooling-air introduction section 108. The toner particles, after having been subjected to an instantaneous heating treatment, are preferably placed in an atmosphere of a temperature not more than the glass transition point by using cold air so as to be cooled to a temperature range which causes no aggregation or bonding of the toner particles. Therefore, the temperature of the cooling air is set at not more than 25° C., preferably not more than 15° C., more preferably not more than 10° C. However, an excessively lowered temperature might cause dew condensation in some conditions and side effects; this must be noted. In the instantaneous heating treatment, together with a cooling effect by cooling water in the device as will be described next, since the time in which the binder resin is in a fused state is kept very short, it is possible to eliminate aggregation between the particles and adhesion of the particles to the device walls of the heat treatment device. Consequently, it becomes possible to provide a superior stability during a continuous production, to greatly reduce the frequency of cleaning for the manufacturing devices, and to stably maintain the yield high.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket (not shown) installed in the cyclones 109 and 114 and in the induction pipe 102". The temperature of cooling water is set at not more than 25° C., preferably not more than 15° C., more preferably not more than 10° C.

In order to maintain a high degree of sphericity (roundness) and to reduce irregularity in shape, it is preferable to further take the following measures.

(1) The amount of toner particles to be supplied to the hot air flow is kept constant without generating pulsating movements, etc. For this purpose, the following measures can be taken.

(i) Pluralities of devices, such as a table feeder 115 shown in FIG. 1 and a vibration feeder, are used in combination so as to improve the quantitative supplying properties. If a high-precision quantitative supply is achieved by using a table feeder and a vibration feeder, finely-pulverizing and classifying processes can be combined so that toner particles can be supplied on-line to the heating treatment process;

(ii) After having been supplied by compressed air, prior to supplying toner particles into hot air, the toner particles are re-dispersed inside the sample-supplying chamber 107 so as to enhance the dispersion uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles is optimized and controlled uniformly.

For this purpose, the following measures can be taken.

(i) The supply of the toner particles into the hot air flow is carried out uniformly, in a highly dispersed state, from all circumferential directions. More specifically, in the case of supply of the toner particles from dispersion nozzles, those nozzles having a stabilizer, etc. are adopted so as to improve the dispersion uniformity of the toner particles that are dispersed from each of the nozzles;

(ii) In order to uniform the dispersion density of the toner particles in the hot air flow, the number of nozzles is set to at least not less than 3, preferably not less than 4, as described earlier. The greater the number, the better the dispersion uniformity. These nozzles are arranged symmetrically with respect to all the circumferential directions. The toner particles may be supplied uniformly from slit sections installed all the circumferential areas of 360°.

(3) Control is properly made so that no temperature distribution of the hot air is formed in the processing area of toner particles so as to apply uniform thermal energy to each of the particles, and the hot air is maintained in a laminar-flow state.

For this purpose, following measures can be taken.

(i) The temperature fluctuation of a heating source for supplying hot air is reduced;

(ii) A straight tube section preceding the hot-air supplying section is made as long as possible. Alternatively, it is preferable to install a stabilizer in the vicinity of the hot-air supplying opening so as to stabilize the hot air. Moreover, the device construction, shown in FIG. 1 as an example, is an open system; therefore, since the hot air tends to be dispersed in a direction in which it contacts with outer air, the supplying opening of the hot air may be narrowed on demands.

(4) The toner particles are subjected to a sufficient fluidizing treatment so as to be maintained in a uniform dispersed state during the heating treatment. For this purpose, the following measures can be taken.

(i) In order to maintain sufficient dispersing and fluidizing properties of the toner particles, it is preferable to use inorganic fine particles (first inorganic fine particles) having BET specific surface area in the range of 100 to 350 $m^2/g$, preferably 130 to 300 $m^2/g$. It is preferable that the inorganic fine particles are hydrophobicized by a publicly known hydrophobicizing agent. An amount of the inorganic fine particles is 0.1 to 6 parts by weight, preferably 0.3 to 3 parts by weight, with respect to 100 parts by weight of the toner particles;

(ii) In a mixing process for improving the dispersing and fluidizing properties of the toner particles, each of the fine particles is preferably located on the surface of the toner particle uniformly in an adhering state without being firmly fixed thereon.

(5) Even when the surface of the toner particle is subjected to heat, particles which have not been softened are located on the surface of the toner particle so that a spacer effect is maintained between the toner particles.

For this purpose, the following measures can be taken.

(i) It is preferable to add the fine particles which have a largish particle size in comparison with the inorganic fine particles described in the section (4) and which do not soften at the treating temperature. The existence of the fine particles on the surface of the toner particle prevents the toner particle surface from forming a surface entirely made from the resin component even after heat is started to be applied, thereby providing the spacer effect between the toner particles and also preventing aggregation and bonding between the toner particles.

(ii) In order to achieve these effects, inorganic fine particles (second inorganic fine particles) having BET specific surface area of 10–100 $m^2/g$, preferably 20–90 $m^2/g$, more preferably 20–80 $m^2/g$ are employed. An addition amount of the second inorganic fine particles is 0.05–5 parts by weight, preferably 0.3–3 parts by weight relative to 100 parts by weight of the toner particles.

In the case where the aforesaid first inorganic fine particles and the second inorganic fine particles are jointly used, it is preferable that a difference between BET specific surface area of the former and that of the latter is adjusted to not less than 30 $m^2/g$, preferably not less than 50 $m^2/g$.

(6) The collection of the heat-treated product is controlled so as not to generate heat.

For this purpose, the following measure can be taken.

(i) The particles that are subjected to the heat treatment and cooling process are preferably cooled in a chiller in order to reduce heat generating in the piping system (especially, in R portions) and in the cyclone normally used in the collection of the toner particles.

(7) In the case of a process wherein a magnetic toner having a relatively greater specific gravity which comprises a small amount of resin component that contributes to the heating treatment is employed, it is preferable to surround the heat-treating space in a cylinder shape so as to increase the time during which the treatment is virtually carried out, or to carry out the treatments plural times.

As mentioned above, various kinds of organic and inorganic fine particles may externally added to the toners which are subjected to the instantaneous heating treatment as described above, it is preferable to externally add the inorganic fine particles having BET specific surface area of 1–350 $m^2/g$. More particularly, from a viewpoint of increasing a fluidity of the toners, the inorganic fine particles having BET specific surface area of 100–350 $m^2/g$, preferably 130–300 $m^2/g$ are employed. It is preferable to hydrophobicize the inorganic fine particles by using a publicly known hydrphobicizing agent. A suitable addition amount of the hydrphobicized inorganic fine particles is 0.1–3 parts by weight, preferably 0.3–1 parts by weight.

Moreover, from a viewpoint of increasing an environmental stability and a durable stability of the toners, inorganic fine particles having BET specific surface area of 1–100 $m^2/g$, preferably 5–90 $m^2/g$, more preferably 5–80 $m^2/g$ are employed. An addition amount of said inorganic fine particles is 0.05–5 parts by weight, preferably 0.3–2 parts by weight.

In the case where the inorganic fine particles for increasing the fluidity and the inorganic fine particles for increasing the stability are jointly employed, it is preferable to select these inorganic fine particles in such a way that a difference between BET specific surface area of the former and that of the latter is not less than 30 $m^2/g$, more preferably not less than 50 $m^2/g$.

In one-component full-color developing method according to the present invention, the toners and the developer-supporting members which satisfy the aforementioned relations are employed in each developing device at the time when one-component developer consisting of the toners for each color is passed through the clearance between the developer-supporting member and the developer-regulating member which is arranged in contact with said developer-supporting member to form the toner thin layer on said developer-supporting member and to electrify the toner particles, said electrified toner particles being conveyed to the developing region as they are in order to successively develop an electrostatic latent image formed on the developer-supporting member for said latent image.

In a full-color image-forming apparatus wherein the method of the present invention is adopted, the developer-supporting members are not particularly restricted in so far as they satisfy the aforementioned ratio ($d_{50}$/Ra) and value (Sm) for each developing device. A different developer-supporting member may be used for each developing device, or the same developer-supporting member may be used for all the developing device. In order to effectively increase the developing speed of the monochromic mode in the present invention, the developer-supporting member to be used in the developing device for the black color and the developer-supporting member to be used in the developing devices for other colors are properly employed. By using these developer-supporting members properly, the aforementioned relations (3) and (4) can easily be satisfied, while the aforesaid ratio ($d_{50}$/Ra) and value (Sm) can also be satisfied.

One-component full-color developing method of the present invention will be explained hereinafter by means of an apparatus wherein said method is adopted.

First of all, an example of one-component contact developing method wherein a contact developing mode is applied to the method of the present invention will be explained by exemplifying the full-color image-forming apparatus shown in FIG. 3, wherein a photosensitive member, an endless intermediate transfer belt and a sheet recording paper are employed as an image supporter, an intermediate transfer and a recording member respectively.

Figure 3:
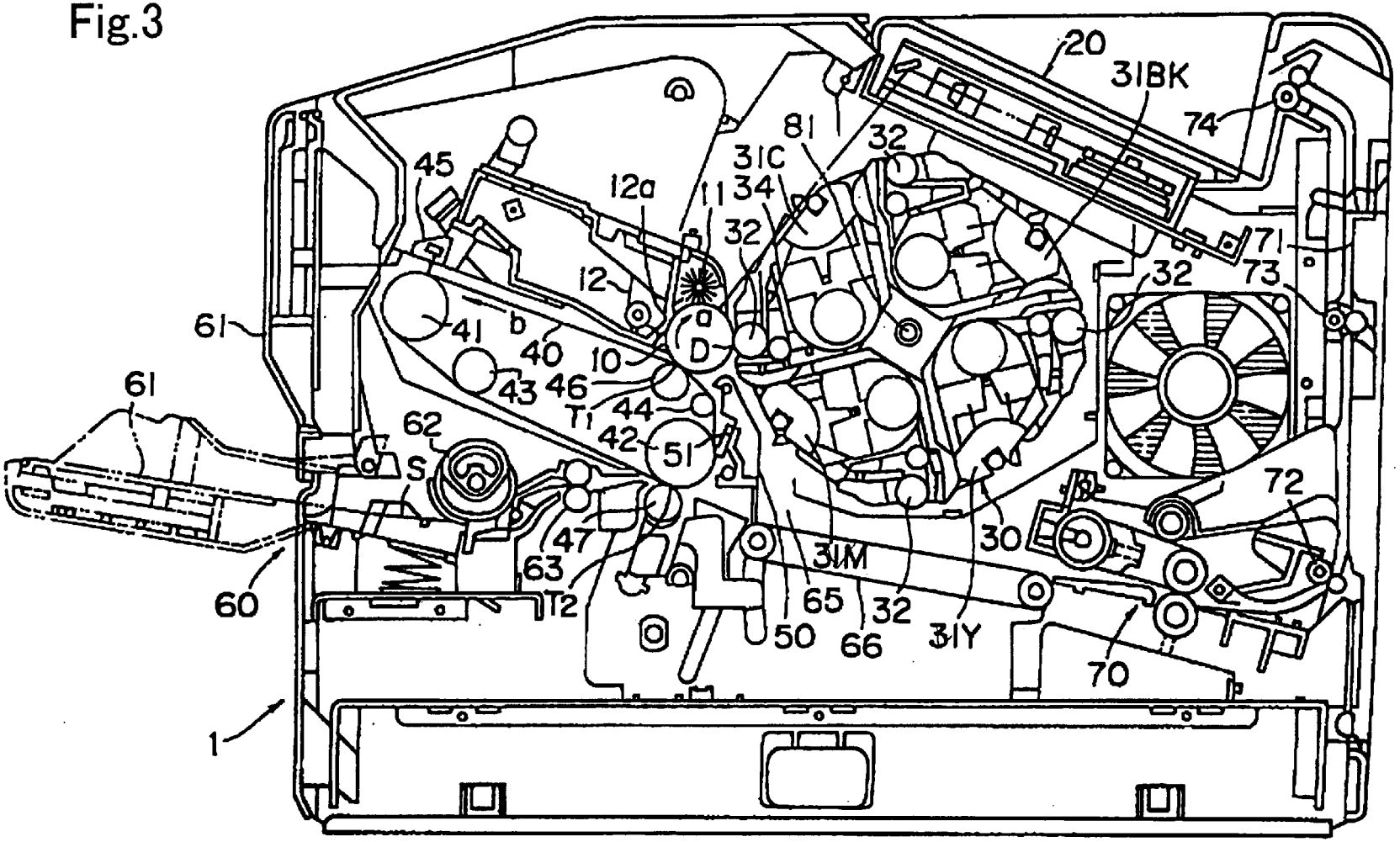
FIG. 3 is a schematic construction of an apparatus for forming one-component full-color image.

The apparatus for forming an image in full-color shown in FIG. 3 is mainly constituted by a photosensitive member drum (image-supporting member) (10) which is rotationally driven in the direction indicated by an arrow (a), an optical system for laser scanning (20), an apparatus for developing an image in full-color (30), an endless intermediate transfer belt (40) which is rotationally driven in the direction indicated by an arrow (b), and a paper supplier (60). Around the photosensitive member drum (10), a charging brush (11) which charges a surface of the photosensitive member drum (10) to the prescribed electric potential and a cleaner (12) equipped with a cleaner blade **(12*a*) which removes the residual toner on the photosensitive member drum (10)** are arranged.

The optical system for laser scanning (20) may be the well known system which has a built-in laser diode, a polygon mirror and a fθ optical element. The printing data concerning C (cyan), M (magenta), Y (yellow) and Bk (black) are individually transmitted to a controller of the optical system from a host computer. The optical system (20) for laser scanning (20) outputs the individual printing data concerning each color as a laser beam in succession to expose the surface of the photosensitive member drum (10) in a scanning way. According to the scanning exposure, an individual electrostatic latent image of each color is formed on the photosensitive member drum (10).

The apparatus for developing an image in full-color (30) is an apparatus wherein four developing devices for each color (31Y, 31M, 31C, 31Bk) are united in a body, said developing device accommodating one-component developer which consists of a nonmagnetic toner of Y, M, C or Bk and being rotable in a clockwise direction on the supporting axis (81) as a fulcrum. Each developing device is equipped with the developing sleeve (developer-supporting member) (32) and the toner-regulating blade (developer-regulating member)(34). The toner conveyed by a rotation of the developing sleeve (32) is charged by passing it through a pressure contacting part (clearance) between the toner-regulating blade (34) and the developing sleeve (32).

The intermediate transfer belt (40) is synchronized with the photosensitive member drum (10) which is stretched endlessly between the support rollers (41, 42) and tension rollers (43, 44) and is driven rotationally in the direction indicated by the arrow (b). A projection (not shown in the figure) is arranged on a side of the intermediate transfer belt (40). The treatments for an image formation, such as an exposure, a development, transfer and the like are controlled by detecting the projection by means of the microswitch (45). The intermediate transfer belt (40) is thrusted by the primary transfer roller (46) to contact with the photosensitive member drum (10), said roller being capable of rotation. The contact part is the primary transfer part ($T_1$). The intermediate transfer belt (40) is contacted with the secondary transfer roller (47) which is capable of rotation through its part supported by the support roller (42). The contact part is the secondary transfer part ($T_2$).

The cleaner (50) is arranged in the space between the aforesaid developing device (30) and the intermediate transfer belt (40). The cleaner (50) has the blade (51) for removing the residual toner on the intermediate transfer belt (40). The blade (51) and the aforesaid secondary transfer roller (47) are contactable and separable against the intermediate transfer belt (40).

The paper supplier (60) is constituted by the paper supplying tray (61) which is openable toward the front of the body (1) of the apparatus for forming an image, the paper supplying roller (62) and the timing roller (63). The recording sheets (S) which are loaded on the paper supplying tray (61) are supplied one by one in the right side of the figure by a rotation of the paper supplying roller (62), and the supplied sheets are synchronized with the image formed in the intermediate transfer belt (40) by means of the timing roller (63) and then transported to the secondary transfer part. The horizontal conveyor road (65) for the recording sheets includes the aforesaid paper supplier (60) and is constituted by the air suction belt (66) and the like. The vertical conveyor road (71) equipped with the conveyor rollers (72, 73, 74) is arranged for the fixing vessel (70). The recording sheets (S) is transported to the top surface of the body (1) of the apparatus for forming an image through the vertical conveyor road (71).

Meanwhile, a printing operation of the aforesaid apparatus for forming an image in full color will be illustrated. When the printing operation is started, the photosensitive member drum (10) and the intermediate transfer belt (40) are rotationally driven at the same speed, and the photosensitive member drum (10) is charged to the prescribed electric potential by means of the charging brush (11).

Then a cyan image is exposed by the optical system for laser scanning (20), and an electrostatic latent image of the cyan image is formed on the photosensitive member drum (10). The electrostatic latent image is immediately developed in the developing device (31C) and the toner image is transferred to the intermediate transfer belt (40) in the primary transfer part. Directly after the end of the primary transfer, the developing device (31M) is switched to the developing part (D), and then an exposure, a development and a primary transfer of a magenta image are carried out. And then a switching to the developing device (31Y) as well as an exposure, a development and a primary transfer of a yellow image is carried out. Furthermore, a switching to the developing device (31Bk) as well as an exposure, a development and a primary transfer of a black image are carried out. Thus the toner images are overlapped on the intermediate transfer belt (40) with every primary transfer.

Figure 4:
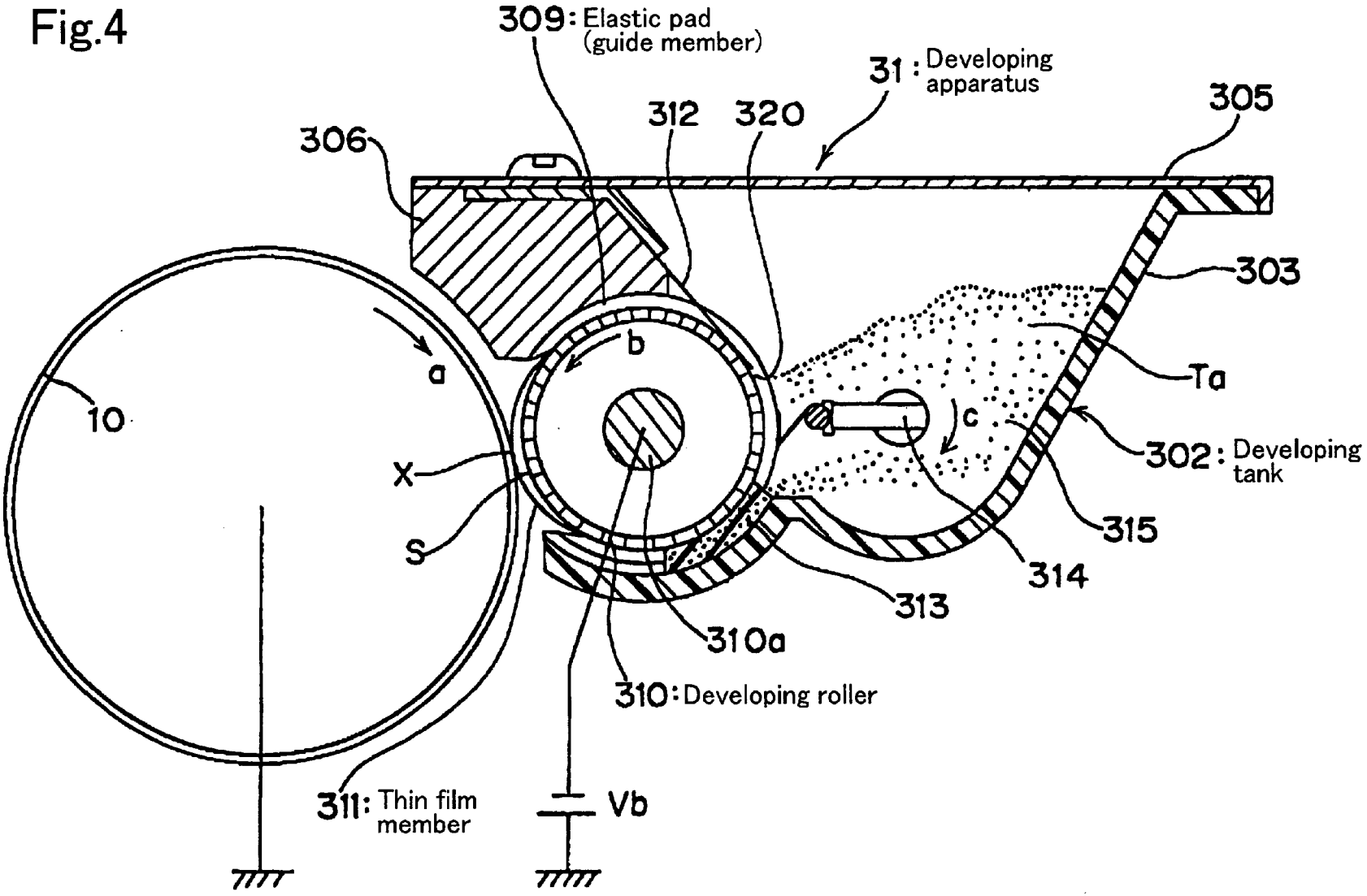
FIG. 4 is a schematic construction of a developing apparatus.

A positional relationship between the photosensitive member drum (10) and each developing device (31C, 31M, 31Y or 31Bk) as well as an outlined construction of the developing device in the apparatus for forming a full-color image shown in FIG. 3 are more precisely shown in FIG. 4.

The developing devices (31) are arranged on a side of the photosensitive member drum (10) which is rotationally driven toward a direction indicated by an arrow (a) in FIG. 4.

A developing tank (302) of the developing devices (31) is constituted by a frame (303) which defines a bottom part and a back part, side plates (404) positioned on both sides (see FIG. 5), a cover (305) and a supporting part (306) attached to a front part of the cover (305).

A metal roller which has a conductive elastomeric material (silicone rubber) on its outer peripheral surface is employed as the developing roller (310), and a developing bias voltage (Vb) is applied to said developing roller.

Figure 6:
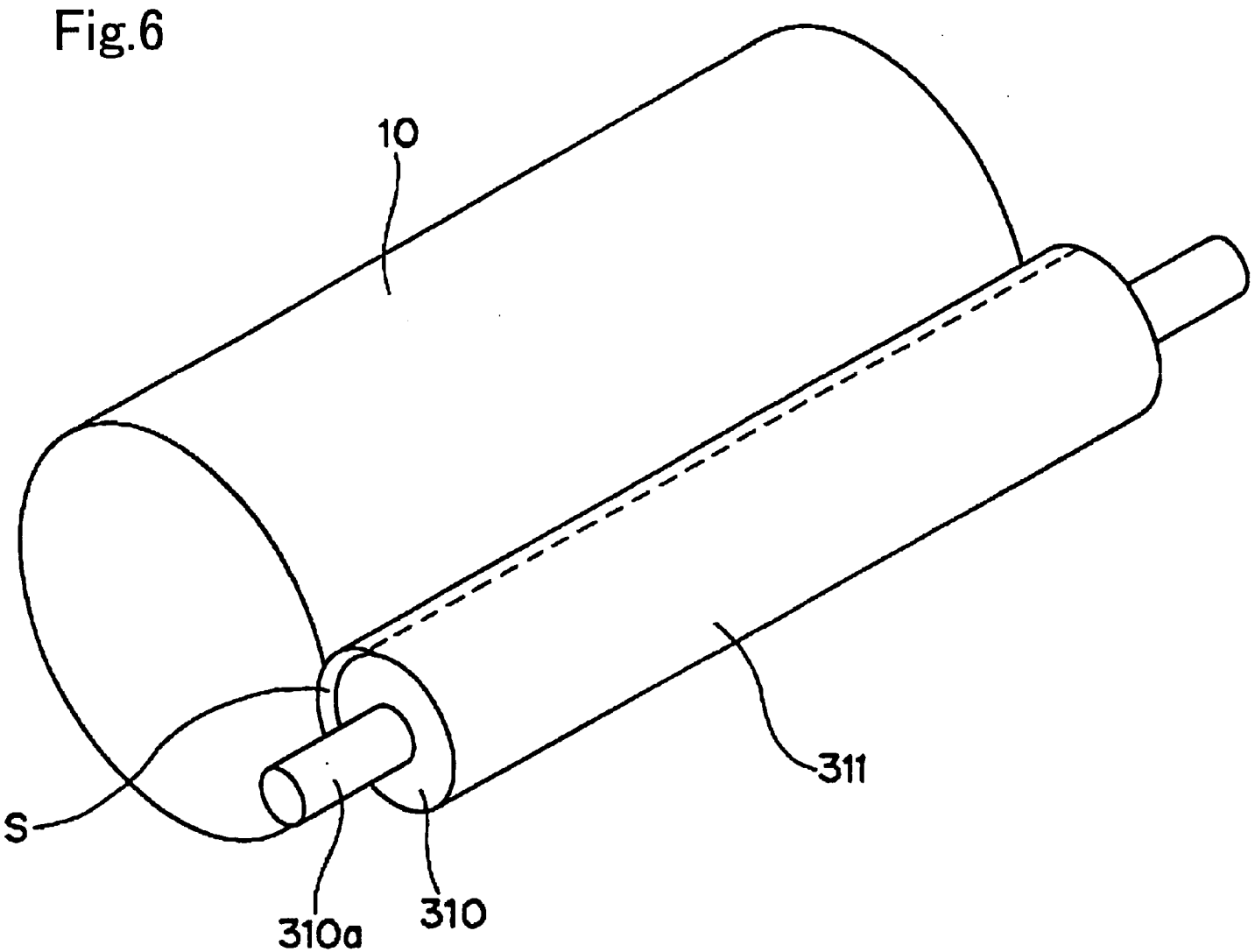
FIG. 6 is a schematic construction which shows a constructional relationship between the developing roller and a photosensitive member drum.

A thin film member (311) is a cylindrical member which has a slightly longish peripheral length in comparison with an outer peripheral length of the developing roller (310). The developing roller (310) is, as shown in FIG. 6, sheathed with the thin film member (311). Although a material of the thin film member (311) is not particularly restricted, a sheet and the like are generally employed which are prepared by adding a carbon black to a soft resin of nylon.

According to the present invention, a surface of the thin film member satisfies the aforementioned values of $d_{50}$/Ra and Sm in relation to the toners. The thin film member is prepared by employing a mold whose molding surface is previously roughened to a desired extent, said mold being used for producing said thin film member. The values of Ra and Sm can be controlled by adjusting a roughening degree of the molding surface of the mold. Furthermore, the values of Ra and Sm may be controlled by adding inorganic fine particles whose mean primary particle size is 5–14 $\mu$m to the thin film member. The value of $d_{50}$/Ra may be controlled by adjusting a weight-average particle size of the toners which are filled in the developing devices.

Figure 5:
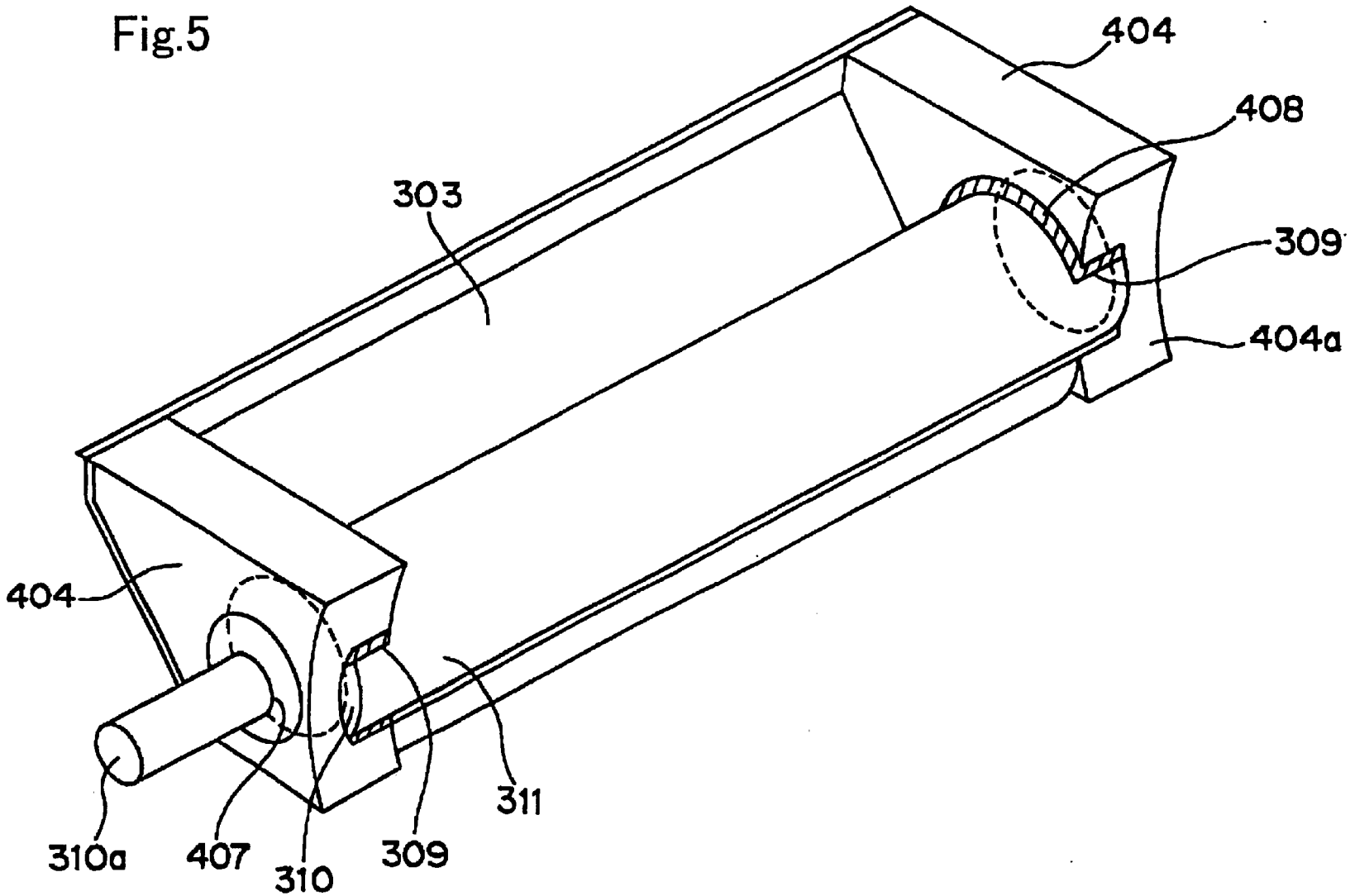
FIG. 5 is a schematic construction of a developing roller which is equipped with a thin film member.

The developing roller (310) which is sheathed with the thin film member (311) is, as shown in FIG. 5, rotatably supported by inserting a support axis (310*a*) through bearing holes (407) (one of them is not shown) of side plates (404) and is drivably connected to a driving source (not shown). Both ends of the developing roller (310) are positioned in concave parts (408) formed in the side plates (404), and an elastic pad (309) for guiding the both ends is interposed between the concave parts (408) and the thin film member (311) with which the developing roller (310) is sheathed in such a way that the thin film member (311) is closely adhered to the outer peripheral surface of the developing roller (310). A foamed pad having the aforementioned polyester film on its surface is employed as the elastic pad.

However, the photosensitive member drum (10) side of the concave part (408) opens to the front (404*a*) of the side plates (404), and the elastic pad (309) does not exist in the opened part.

Accordingly, the part of the thin film member (311) which is in contact with the elastic pad (309) is closely adhered to the outer peripheral surface of the developing roller (310). In other part of the thin film member (311), i.e. in the part of said member which is located in the front (404*a*) of the side plates (404), an extra part of the thin film member (311) whose length is slightly longish in comparison with the peripheral length of the developing roller (310) is concentrated, and a space (S) is formed between the thin film member (311) and the developing roller (310), and the outer peripheral surface of the thin film member (311) which covers the space (S) is in contact with the peripheral surface of the photosensitive member drum (10).

Furthermore, the elastic pad (309), the developing roller (310) and the thin film member (311) are selected in such a way that a dynamic coefficient of friction ($\nu 1$) between the outer peripheral surface of the developing roller (310) and the inner peripheral surface of the thin film member (311) and the dynamic coefficient of friction ($\nu 2$) between the outer peripheral surface of the thin film member (311) and the elastic pad (309) satisfy the following relation:

$\nu 1 > \nu 2$

Therefore, when the developing roller (310) rotates in a direction indicated by an arrow (b), the thin film member (311) rotates in a driven manner without causing a slip between said member and the developing roller, and the outer peripheral surface of the thin film member (311) which covers the space (S) causes a sliding friction on the surface of the photosensitive member drum (10) with a suitable nip width.

A blade (312) is installed on the back side of the supporting member (306) arranged on the upper side of the developing roller (310). The blade (312) is in close contact with the diagonal upper part of the back side of the developing roller (310) by way of the thin film member (311). A spring metallic thin plate made of SUS is employed as the blade (312).

A toner-levelling pad (313) which is constituted by an elastic layer made of foamed urethane whose surface is covered with a silicone rubber sheet is installed on the opposite side of the frame (303) to the developing roller (310). The toner-levelling pad (313) is in contact with the outer peripheral surface of the developing roller (310) by way of the thin film member (311).

A toner-containing tank (315) is formed in the rear side of the developing tank (302). The toner-containing tank (315) is equipped with an agitator (314) which is rotatable in the direction indicated by an arrow (c). The agitator (314) is arranged so as to remove the toner (To) contained in the toner-containing tank (315) toward the direction indicated by an arrow (c) and to prevent a blocking and the like of the toner.

An operation of each developing device (31) having the aforementioned construction will be illustrated hereinafter. In the situation that the developing roller (310) and the agitator (314) rotate in the directions indicated by arrows (b) and (c) respectively, the toner (To) in the toner-containing tank (315) is compulsorily removed toward the direction indicated by the arrow (c) by an agitating action of the agitator (314).

On the other hand, the thin film member (311) is removed in a driven manner toward the direction indicated by the arrow (b) by a frictional force between said member and the developing roller (310), and the toner (To) which is in contact with the thin film member (311) is received a conveying force toward the direction of arrow (b), said conveying force being caused by the contact with the thin film member (311) and an electrostatic force. Then the toner (To) is collected into a wedge-shaped collecting part (320) which is formed between the thin film member (311) and an edge of the blade (312). When the toner (To) arrives at the close contact part of the blade (312), the toner is uniformly coated as a thin layer on the surface of the thin film member (311) and is frictionally electrified.

When the toner carried on the thin film member (311) is conveyed to the opposite part (the developing region (X)) to the photosensitive member drum (10) by an action of the thin film member (311) which is dependently driven by a rotation of the developing roller (310), the toner is adhered to the electrostatic latent image formed on the surface of the photosensitive member drum (10) to form a toner image, said adhesion being attributable to a potential difference between a surface potential of the photosensitive member drum (10) and a bias voltage applied to the developing roller (310).

Since the thin film member (311) which is in contact with the photosensitive member drum (10) is not in contact with the developing roller (310) through the space (S), the thin film member (311) is softly and uniformly contacted with the photosensitive member drum (10) with a suitable nip width to form a uniform toner image on the electrostatic latent image of the photosensitive member drum (10). In the case where a speed difference is made between the peripheral speed of the photosensitive member drum (10) and the speed of the thin film member (311), an effect of removing the fogging in a nonimage part can be obtained without causing a destruction of the toner image which has been formed on the photosensitive member drum (10).

The toner (To) which has been passed through the developing region (X) is successively conveyed together with the thin film member (311) toward the direction indicated by the arrow (b), and a uniformization of a surface toner layer can be achieved, since a consumption pattern of the toner (To) which has been consumed in the developing region (X) is eliminated at the time of passing through the toner-levelling pad (313).

And then a uniform thin layer of the electrified toner is formed again on the surface of the thin film member (311) at the close contact part of the blade (312), and the aforementioned operation will be repeated thereafter.

Although the nonmagnetic contact development mode is applied to all the developing devices (31C, 31M, 31Y, 31Bk) in the aforesaid apparatus for forming a full-color image, the present invention is not restricted to this development mode, and other different development modes may be adopted.

For example, a nonmagnetic noncontact development mode, a magnetic noncontact development mode, a magnetic contact development mode and the like are enumerated as the other development modes.

Figure 7:
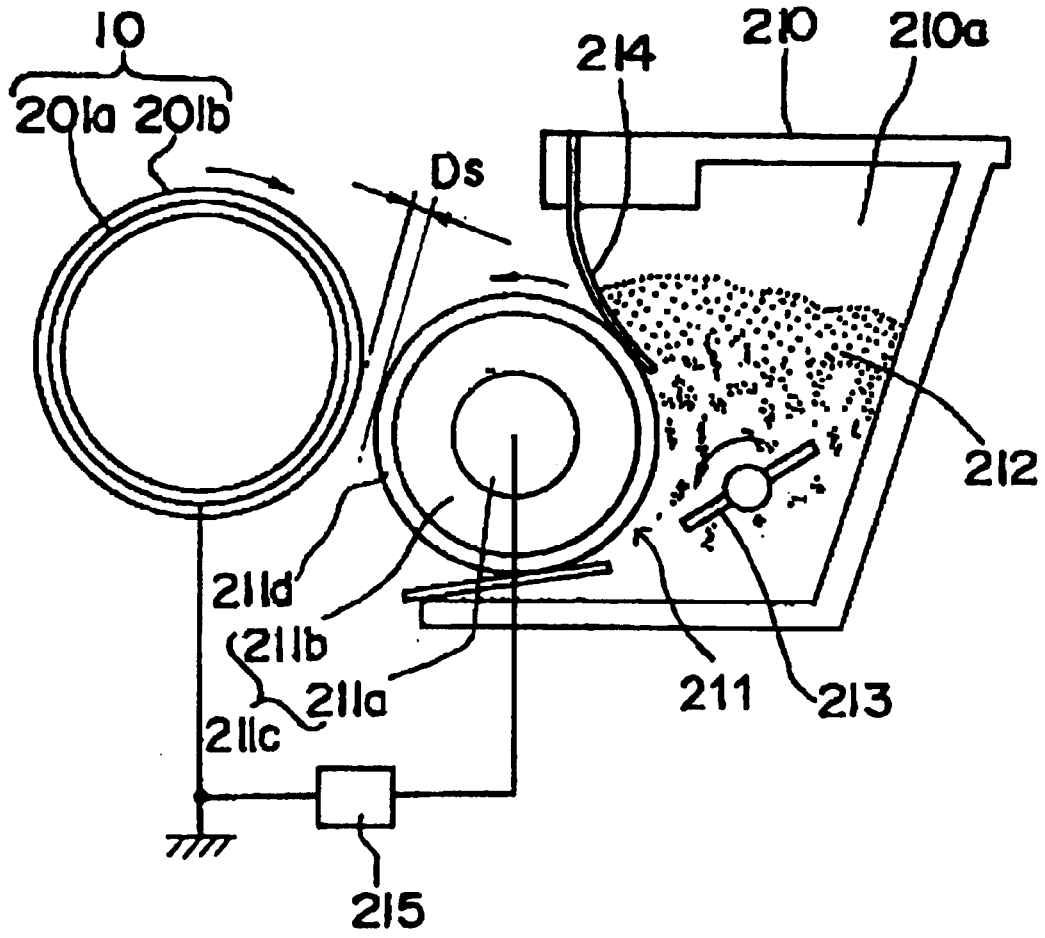
FIG. 7 is a schematic construction of a contactless one-component developing apparatus for a nonmagnetic toner.

For example, one example of the method of one-component noncontact development wherein the nonmagnetic noncontact development mode is applied to the method of the present invention will be illustrated by exemplifying a developing apparatus shown in FIG. 7.

As shown in FIG. 7, the developing apparatus is equipped with an image-supporting member (10) which is constituted by a photosensitive member drum wherein a photosensitive layer (201*b*) is formed on a surface of a cylindrical conductive supporting member (201*a*). After the surface of the image-supporting member (10) is electrified by means of an electrifying apparatus (not shown), light is irradiated on the surface of the image-supporting member (10) by means of a suitable exposuring apparatus (not shown) to form an electrostatic latent image on the surface of the image-supporting member according to an image information.

A conductive substrate (211*c*) is constituted by a conductive rotating shaft (211*a*) and a conductive elastic layer (211*b*) which covers an outer peripheral surface of said rotating shaft is employed as a developer-supporting member (211), said substrate having a high resistant layer (211*d*) on its outer peripheral surface. The developer-supporting member (211) is arranged in such a manner that it is opposed to the image-supporting member (10) by leaving a necessary space between the both. Therefore, the high resistant layer (211*d*) of the developer-supporting member (211) is opposed to the image-supporting member (10) by way of a suitable space.

As a base material which constitutes the conductive elastic layer (211*b*) which covers the outer peripheral surface of the rotating shaft (211*a*), for example, rubbery materials, such as ethylene-propylene-diene-methylene copolymerization rubber (EPDM), silicone rubber, urethane rubber and the like are employed. Mixtures of the rubbery materials and a dispersed carbon black (e.g. ketchen black, acetylene black, furnace black and the like) are generally used, said mixtures having an inherent volume resistance of not more than 106 Ω·cm.

On the other hand, a base material which constitutes the high resistant layer (211*d*) which covers the surface of the conductive elastic layer (211*b*) is not particularly restricted. Resinous materials (e.g. nylon, urethane and the like) having an inherent volume resistance of not less than $10^{10}$ Ω·cm are generally used. A thickness of the high resistant layer (211*d*) is usually 10–150 μm, preferably 50–100 μM.

According to the present invention, the surface of the high resistant layer (211*d*) satisfies the aforementioned values of $d_{50}$/Ra and Sm in relation to the toners. The values of $d_{50}$/Ra and Sm of the high resistant layer (211*d*) can be adjusted by adding fine particles to said layer, and the value of $d_{50}$/Ra may be adjusted by controlling the weight-average particle size of the toners which are loaded into the developing apparatus. Furthermore, the values of $d_5$/Ra and Sm can be adjusted by roughening the molding surface of the mold for producing the high resistant layer in such a way that said molding surface has a desired roughness.

The developer (nonmagentic toner)(212) is loaded into a receiving part (210*a*) of a body (210) of the developing apparatus which is equipped with the developer-supporting member (211). The developer (212) in the receiving part (210*a*) is conveyed to the developer-supporting member (211) by means of a rotatable feed blade (213) to retain the developer (212) on the surface of the developer-supporting member (211), and then the developer (212) on said surface is conveyed to the developing region which is opposed to the image-supporting member (10) by a rotation of the developer-supporting member (211).

In the course of conveying the developer (212) to the developing region which is opposed to the image-supporting member (10) by means of the developer-supporting member (211), the developer-regulating member (214) is closely contacted with the surface of the developer-supporting member (211) which is arranged in the body (210) of the developing apparatus. By the function of the developer-regulating member (214), not only an amount of the developer (212) which is conveyed by the developer-supporting member (211) is regulated, but also the developer (212) is electrified by friction.

The developer-regulating member (214) is made of, for example, stainless steel or phosphor bronze. A plate spring made of these materials whose thickness is 0.08–0.2 mm is employed as the developer-regulating member (214).

The developer (212) which has been regulated and frictionally electrified by means of the developer-regulating member (214) is conveyed to the developing region which is opposed to the image-supporting member (10) by the developer-supporting member (211), and at the same time, the bias voltage for development which is generated by overlapping a direct current voltage and an alternating current voltage is applied to the developer-supporting member (211) from an electric source (215) to exert an electric field between the conductive substrate (211*c*) of the developer-supporting member (211) and the image-supporting member (10), said electric field being generated by overlapping a direct current electric field and an alternating electric field. According to these electrical operations, the developer (212) retained on the surface of the developer-supporting member (211) is supplied to the electrostatic latent image formed on the image-supporting member to carry out the development.

Figure 8:
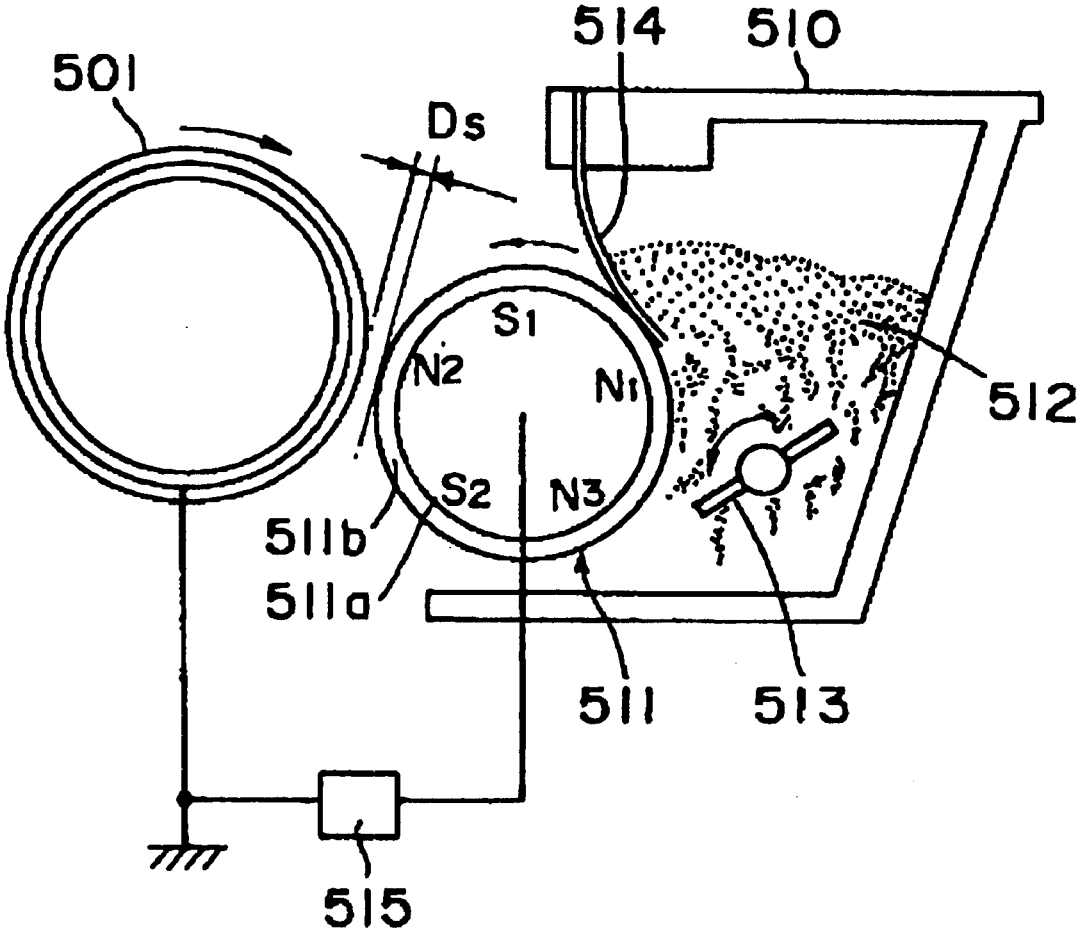
FIG. 8 is a schematic construction of a contactless one-component developing apparatus for a magnetic toner.

At the time of applying the direct current voltage and alternating current voltage from the electric source, the ratio of Vpp/Ds (wherein Vpp is peak-to-peak value of the alternating current voltage, and Ds is an opposing space between the conductive substrate (211*c*) of the developer-supporting member (211) and the image-supporting member (10)) is adjusted to 4–9 kV/mm, said ratio meaning a strength of the alternating electric field which exerts between the conductive substrate (211*c*) of the developer-supporting member (211) and the image-supporting member Now one example of the method of one-component noncontact development wherein the magnetic noncontact development mode is applied to the method of the present invention will be illustrated by exemplifying a developing apparatus shown in FIG. 8.

As shown in FIG. 8, a developing sleeve (511*b*) which is constituted by an aluminum cylinder is employed as the developer-supporting member (511) which conveys the developer. On the inner peripheral side of the developing sleeve (511*b*), a magnet roller (511*a*) having plural magnetic poles (N1, S1, N2, S2) is fixed. The outer peripheral surface of the developing sleeve (511*b*) is covered with a urethane layer which has a thickness of 30 μm and a volume resistance of $7\times10^{10}$ Ω·cm. The developing sleeve (511*b*) is rotatably retained in such a manner that said sleeve is opposed to a photosensitive member (501) in the development region by way of a suitable space (Ds).

A material which constitutes the surface layer of the developing sleeve (511*b*) is not restricted to the aforesaid material. Resinous materials (e.g. nylon, urethane and the like) having an inherent volume resistance of not less than $10^{10}$ Ω·cm are generally employed. A thickness of the resinous surface layer is usually 1–5 mm.

According to the present invention, the surface of the surface layer of the developing sleeve (511*b*) satisfies the aforementioned values of $d_{50}$/Ra and Sm in relation to the toners. These values of $d_{50}$/Ra and Sm concerning said surface can be adjusted by adding fine particles to an inside of the surface layer. The value of $d_5$/Ra may be adjusted by controlling the weight-average particle size of the toner to be loaded into the developing apparatus.

Furthermore, the developer (magnetic toner)(512) is loaded into a body (510) of the developing apparatus, said body being arranged on the opposite side to the development region wherein the developer-supporting member (511) is opposed to the image-supporting member (501). An agitator (513) is arranged in the body (510) of the developing apparatus in such a way that the developer (512) contained in said body is supplied to the surface of the developer-supporting member (511) by a rotatory motion of the agitator (513).

In the course of conveying the developer (512), which has been supplied to said surface, to the developing region which is opposed to the image-supporting member (501) by the rotatory motion of the developer-supporting member (511), the developer-regulating member (514) which is arranged in the body (510) is closely contacted with the surface of the developer-supporting member (511). By the function of the developer-regulating member (514), not only an amount of the developer (512) which is conveyed to the developing region by the developer-supporting member (511) is regulated, but also the developer (512) which exists on the surface of the developer-supporting member (511) is electrified by friction.

The developer (512) whose amount to be conveyed has been regulated and which has frictionally been electrified by the developer-regulating member (514) is conveyed to the developing region which is opposed to the image-supporting member (501) by the developer-supporting member (511), and a bias voltage for development from an electric source (515) is applied to the developer-supporting member (511), and the developer (512) retained on the surface of the developer-supporting member (511) is supplied to an electrostatic latent image formed on the image-supporting member (501) to carry out the development.

In the developing apparatus wherein the developer (512) is retained on the surface of the developer-supporting member (511) which is opposed to the image-supporting member (501) at a necessary space in order to supply said developer to the developing region which is opposed to the image-supporting member (501) and wherein the alternating voltage is applied to the image-supporting member (501) in order to carry out the development, a peak-to-peak value (Vpp) of the alternating voltage which is applied to the developer-supporting member and an opposing space (Ds) between the conductive substrate of the developer-supporting member and the image-supporting member satisfy the following relation:

$$4\ \text{kV/mm} \leqq V_{pp}/Ds \leqq 9\ \text{kV/mm}$$

Although the present invention will be more concretely illustrated by the following examples hereinafter, the present invention is not restricted to these examples.

EXAMPLES

Preparation Examples of Resins 1–5

Into a four-knecked flask equipped with a thermometer, a stirring rod made of stainless steel, a dropping-type condenser and a nitrogen gas inlet pipe were charged the monomers shown in Table 1 in a molar ratio indicated in said table together with a polymerization initiator (dibutyltin oxide). The mixtures were heated on a mantle heater under agitation in nitrogen atmosphere in order to carry out a reaction. The obtained polyester resins were granulated to prepare resin particles whose particle size is not more than 1 mm. These resin particles were employed for preparing the following toners.

TABLE 1

| | BPA-PO | BPA-EO | TPA | TMA | SA | FA | Tg (° C.) | Tm (° C.) | Mn | Mw/Mn | Acid Value (KOHmg/g) |
|---|---|---|---|---|---|---|---|---|---|---|---|
| Resin 1 | 7 | 3 | 4 | 5 | 4 | 0 | 61.5 | 152.3 | 2112 | 10.86 | 20 |
| Resin 2 | 9 | 1 | 2 | 0 | 0 | 9 | 60.3 | 109.0 | 2240 | 13.65 | 23 |
| Resin 3 | 7 | 3 | 7 | 2 | 0 | 0 | 60.1 | 140.0 | 3700 | 50.12 | 3.6 |
| Resin 4 | 9 | 2 | 4 | 0 | 0 | 0 | 60.5 | 105.0 | 3300 | 3.45 | 6.5 |
| Resin 5 | 7 | 4 | 5 | 0 | 0 | 5 | 60.3 | 102.0 | 6712 | 3.49 | 5.2 |

BPA-PO: Bisphenol A-propylene oxide adduct
BPA-EO: Bisphenol A-ethylene oxide adduct
TPA: Terephthalic acid
TMA: Trimellitic acid
SA: Succinic acid
FA: Fumaric acid The glass transition point of the resin was measured by a differential scanning calorimeter (DSC-200: made by Seiko Denshi K.K.) in which alumina was used as the reference, and 10 mg of a sample was measured under the conditions of a temperature-rise rate of 10° C./min and at temperature ranging from 20 to 160° C. The shoulder value of the main endothermic peak was defined as the glass transition point.

The softening point of the resin was measured by a Flow Tester (CFT-500; made by Shimadzu Seisakusho K.K.). A sample (1 $cm^3$) was fused and flowed under the following conditions; pore of die (diameter 1 mm, length 1 mm), a pressure of 20 $kg/cm^2$ and a temperature-rising rate of 6° C./min. Temperature corresponding to a ½ of the height from the start point to the completion point of the flowing was defined as a softening point.

The number-average molecular weight and the weight-average molecular weight of the resin were measured by means of a gel permeation chromatography (807-IT type: Nippon Bunko Kogyo K.K.). A sample (30 mg) was dissolved in tetrahydrofuran (20 ml), and 0.5 mg of said solution, together with a carrier solvent (tetrahydrofuran)(10 $kg/cm^3$), was injected into a column (40° C.), and these molecular weight values were determined by polystyrene conversion method.

Black toner 1

| Components of the toner | parts by weight |
|---|---|
| Resin 1 | 60 |
| Resin 2 | 40 |
| Carbon Black (Mogal L; Cavot Co.) | 4 |
| Metal complex of zinc salicylate (E-84; Orient Kagaku Kogyo Co.) | 2 |
| Low molecular polypropylene of oxide type (Biscol TS2000; Sanyo Kasei Kogyo Co.) | 2 |

The above components were sufficiently mixed by means of Henschel Mixer, and the mixture was fused and kneaded by means of a twin screw extruding kneader (PCM-30; Ikegai Tekko Co.) whose bore of discharging nozzle was enlarged. The obtained kneaded mixture was quickly cooled, and then coarsely pulverized by a feather mill. The coarsely pulverized mixture was further pulverized to classify the coarse particles by means of a jet pulverizer (IDS; Nippon Pneumatic Kogyo Co.), and then the residual fine particles was classified by means of DS classifier (Nippon Pneumatic Kogyo Co.) to obtain the toner particles having a weight-average particle size of 7.1 $\mu$m.

Hundred parts by weight of the toner particles obtained, 0.5 part by weight of a hydrophobic silica having BET specific surface area of 225 $m^2/g$ (TS-500; Cavozil Co.) and 1.0 part by weight of a treated product (BET specific surface area: 65 $m^2/g$, pH: 6.0, degree of hydrophobicization: not less than 65%) of a hydrophobic silica (AEROSIL 90G: Nippon Aerosil Co.) with hexamethylene silazane were mixed for 60 sec by means of Henschel mixer (peripheral speed: 40 m/sec). The mixture was subjected to a surface modifying treatment under the following conditions by means of the instantaneous heating apparatus having a construction as shown in FIG. 1 in order to obtain the black toner 1 having a weight-average particle size of 7.1 $\mu$m.

| | |
|---|---|
| Developer-supplying section: | Table feeder and vibration feeder |
| Number of dispersing nozzle: | 4 (each nozzle was arranged at an interval of 90° for the circumference) |

-continued

| | |
|---|---|
| Ejecting angle: | 30° |
| Flow rate of hot air: | 800 L/min |
| Flow rate of dispersing air: | 55 L/min |
| Flow rate of suction air: | −1200 L/min |
| Dispersion concentration: | 100 $g/m^3$ |
| Treating temperature: | 250° C. |
| Residence time: | 0.5 sec |
| Temperature of cooling air: | 15° C. |
| Temperature of cooling water: | 10° C. |

Black Toner 2

The black toner 2 was obtained by the same preparation method as that for the black toner 1 except that (i) a magnetic powder (magnetite EPT-1000; Toda Kogyo Co.) was additionally used as a component of the toner, and (ii) a pulverizing condition, a classifying condition and a surface modifying condition were suitably changed.

Black Toner 3

The black toner 3 was prepared by the same preparation method as that for the black toner 1 except that the resin 3 (40 parts by weight) and the resin 4 (60 parts by weight) were used as a resin component.

Black toner 4

The black toner 4 was prepared by the same preparation method as that for the black toner 1 except that a pulverizing condition, a classifying condition and a surface modifying condition were suitably changed.

C·M·Y Toner 1

(i) Cyan Toner 1

A mixture of the resin 3 (14 parts by weight), the resin 4 (56 parts by weight) and a cyan pigment (C.I.pigment blue 15:3)(30 parts by weight) was kneaded by means of a pressure kneader. The kneaded mixture obtained was cooled, and then pulverized by means of a feather mill to obtain a pigment master batch.

The cyan toner 1 was obtained by the same preparation method as that for the black toner 1 except that (i) the resin 3 (18.6 parts by weight) and the resin 4 (4.4 parts by weight) were used as a resin component, and (ii) the pigment master batch was used as a substitute for the carbon black.

(ii) Magenta toner 1 and Yellow Toner 1

The magenta toner 1 or the yellow toner 1 was obtained by the same preparation method as that for the cyan toner 1 except that a magenta pigment (C.I. pigment red 184) or a yellow pigment (C.I. pigment yellow 180) was used as a pigment.

These cyan toner 1, magenta toner 1 and yellow toner 1 are collectively referred to as C·M·Y toner 1.

C·M·Y Toner 2

(i) Cyan Toner 2

A mixture of the resin 1 (42 parts by weight), the resin 2 (28 parts by weight) and a cyan pigment (C.I.pigment blue 15:3)(30 parts by weight) was kneaded by means of a pressure kneader. The kneaded mixture obtained was cooled, and then pulverized by means of a feather mill to obtain a pigment master batch.

The cyan toner 2 was obtained by the same preparation method as that of the black toner 1 except that the resin was replaced with the resin 1 (55.8 parts by weight) and the resin 2 (37.2 parts by weight) and that the carbon black was replaced with the pigment master batch (10 parts by weight).

(ii) Magenta Toner 2and Yellow Toner 2

The magenta toner 2 or the yellow toner 2 was obtained by the same preparation method as that of the cyan toner 2 except that a magenta pigment (C.I. pigment red 184) or a yellow pigment (C.I. pigment yellow 180) was employed as the pigment.

The cyan toner 2, the magenta toner 2 and the yellow toner 2 are collectively referred to as C·M·Y toner 2.

TABLE 2

| Toners | Used resins L | Used resins H | Used resins H/L | tanδ | Weight-average particle size ($d_{50}$) | Mean roundness | Standard deviation of roundness | $D/d_{50}$ | Note[1)] |
|---|---|---|---|---|---|---|---|---|---|
| Black toner 1 | Resin 1 | Resin 2 | 60/40 | 0.95 | 7.1 | 0.962 | 0.035 | 0.52 | N |
| Black toner 2 | Resin 1 | Resin 2 | 60/40 | 0.97 | 7.0 | 0.960 | 0.034 | 0.25 | M |
| Black toner 3 | Resin 3 | Resin 4 | 40/60 | 1.05 | 7.1 | 0.960 | 0.035 | 0.54 | N |
| Black toner 4 | Resin 1 | Resin 2 | 60/40 | 0.95 | 6.9 | 0.950 | 0.037 | 0.36 | N |
| C·M·Y toner 1 | Resin 3 | Resin 4 | 20/80 | 1.2 | 7.0 | 0.962 | 0.034 | 0.54 | N |
| C·M·Y toner 2 | Resin 1 | Resin 2 | 60/40 | 0.95 | 7.1 | 0.959 | 0.035 | 0.52 | N |
| C·M·Y toner 3 | Resin 5 | | — | 1.3 | 7.2 | 0.960 | 0.036 | 0.53 | N |
| C·M·Y toner 4 | Resin 3 | Resin 4 | 20/80 | 1.2 | 7.0 | 0.951 | 0.039 | 0.35 | N |

[1)]N: nonmagnetic M: magnetic

C·M·Y Toner 3

(i) Cyan Toner 3

A mixture of the resin 5 (70 parts by weight) and a cyan pigment (C.I.pigment blue 15:3)(30 parts by weight) was kneaded by means of a pressure kneader. The kneaded mixture obtained was cooled, and then pulverized by means of a feather mill to obtain a pigment master batch.

The cyan toner 3 was obtained by the same preparation method as that of the black toner 1 except that the resin was replaced with the resin 5 (93 parts by weight) and that the carbon black was replaced with the pigment master batch (10 parts by weight).

(ii) Magenta Toner 3 and Yellow toner 3

The magenta toner 3 or the yellow toner 3 was obtained by the same preparation method as that of the cyan toner 3 except that a magenta pigment (C.I. pigment red 184) or yellow pigment (C.I. pigment yellow 180) was employed as the pigment.

The cyan toner 3, the magenta toner 3 and the yellow toner 3 are referred to as C·M·Y toner 3.

C·M·Y Toner 4

(i) Cyan Toner 4

The cyan toner 4 was obtained by the same preparation method as that of the cyan toner 1 except that the pulverizing condition, classifying condition and surface modifying condition were suitably changed.

(ii) Magenta Toner 4 and Yellow Toner 4

The magenta toner 4 or the yellow toner 4 was obtained by the same preparation method as that of the cyan toner 4 except that a magenta pigment (C.I. pigment red 184) or a yellow pigment (C.I. pigment yellow 180) was employed as the pigment.

The cyan toner 4, the magenta toner 4 and the yellow toner 4 are collectively referred to as C·M·Y toner 4.

Values of tan δ, weight-average particle size ($d_{50}$)(μm), mean roundness, standard deviation of roundness and $D/d_{50}$ of the black toners 1–4 and C·M·Y toners 1–4 as prepared above were measured. The results obtained are summarized in Table 2.

The values of tan δ were determined by measuring the temperature dependency of tan δ of each toner under the following conditions by means of Dyn Alyser DAR-100 (REOLOGICA Co.) and then reading the tans of each toner at 150° C. based on the results of the measurement: frequency; 1 Hz, strain rate; 5% automatic, speed of temperature rise; 2° C./min.

The weight-average particle size was measured by means of Coulter Multisizer (Coulter Counter Co.) equipped with the aperture tube whose diameter is 50 μm.

The mean roundness and the standard deviation were measured by means of the flow-type particle image analyzer EPIA-1000 (manufactured by Toa Iyou Denshi K.K.).

The true density (ρ) which is necessary for a calculation of $D/d_{50}$ was measured by means of the air-relative specific gravity hydrometer (manufactured by Beckman Co.), and the BET specific surface area (S) was measured by means of Flow Sorb 2300-type (manufactured by Shimazu Seisakusho K.K.).

Each toner (100 parts by weight), hydrophobic silica R972 (Nippon Aerosil K.K) having BET specific surface area of 110 $m^2/g$ (0.5 part by weight) and strontium titanate particles having BET specific surface area of 9 $m^2/g$ (0.3 part by weight) were mixed at 30 m/sec for 180 sec by means of Henschel mixer. The mixture obtained was sieved by means of the circular vibrating sieve (mesh size: 77 μm).

Developer-supporting Members 1–10

Various developer-supporting members 1–10 having various Ra and Sm were prepared by forming a high-resistance layer (30 μm) made of a urethane (inherent volume resistance: $7\times10^{10}$ Ω·cm) which contains fine graphite particles on a conductive substrate constituted by a rotating shaft made of stainless steel and a conductive layer made of EDPM (inherent volume resistance: $10^5$ Ω·cm) which is arranged around said rotating shaft.

Developer-supporting Member 11

The developer-supporting member 11 was prepared by forming a urethane layer (thickness: 30 μm, volume resistance $7\times10^{10}$ Ω·cm), which contains fine graphite particles which roughen a surface of said layer, on an outer surface of a cylindrical developer-supporting member made of alminum which comprises a magnet roller having plural magnetic poles (N1, S1, N2, S2), said magnetic poles being fixed on an inner peripheral surface of the magnet roller.

The surface roughness (Ra)(μm) and the mean crest distance (Sm)(μm) of the various developer-supporting member 1–11 were measured by means of SURFCOM 1400 (manufactured by Tokyo Seimitsu K.K.).

TABLE 3

| Developer-supporting member | Ra (μm) | Sm (μm) |
|---|---|---|
| 1 | 5.0 | 80 |
| 2 | 3.0 | 50 |
| 3 | 17.0 | 80 |

TABLE 3-continued

| Developer-supporting member | Ra (μm) | Sm (μm) |
|---|---|---|
| 4 | 17.0 | 50 |
| 5 | 2.0 | 80 |
| 6 | 2.0 | 50 |
| 7 | 5.0 | 201 |
| 8 | 5.0 | 201 |
| 9 | 5.0 | 15 |
| 10 | 5.0 | 15 |
| 11 | 5.0 | 80 |

Example 1–3 and Comparative examples 1–7

Various combinations of the black toners and C·M·Y toners shown in Table 4 were employed in the examples 1–3 and the comparative examples 1–7, and the aftermentioned characteristis properties of these combinations were evaluated according to the following procedures. A remodeled machine of the full-color printer (Color Page Pro EX manufactured by Minolta Co, Ltd.) having the construction shown in FIG. 3 which is equipped with 4 developing devices having the construction shown in FIG. 7 was employed for these evaluations. To say more precisely, the developer-supporting member shown in Table 4 were substituted for a developer-supporting member loaded in each developing device (black developing device, cyan (C) developing device, magenta (M) developing device, yellow (Y) developing device) of the full-color printer in each example or comparative example. The same developer-supporting member was employed in the cyan developing device, magenta developing device and yellow developing device. Setting conditions of the full-color printer are as follows:

| | |
|---|---|
| Developing amount; 0.8 mg/cm$^2$ | (common to all developing devices) |
| Developing bias; −300 V | (common to all developing devices) |
| System speed; 200 mm/sec | (common to all developing devices) |
| Peripheral speed of the sleeve; 350 mm/sec | (common to all developing devices) |
| Vibrating electric field (Vp-p/Ds); 7.5 kV/mm | (common to all developing devices) |

In the case of the example 2, a remodeled machine of the full-color printer which is equipped with the black developing device having the construction shown in FIG. 8 was employed for the following evaluations. Setting conditions of the black developing device are as follows:

Developing amount; 0.8 mg/cm$^2$

Direct current bias; −450 V

System speed ; 200 mm/sec

Peripheral speed of the developer-supporting member; 350 mm/sec

Vibrating electric field (Vp−p/Ds); 7.5 kV/mm

Each toner was loaded in each developing device, and various images were printed in a monochromic mode or full-color mode. The printed images were evaluated according to the following methods.

(Glossiness of Letter Parts)

Monochromic letter images (B/W; 30%) were printed in a monochromic mode, and a glossiness of the letter parts of the copied images on the fifth sheet was measured at 60° by means of a glossimeter (manufactured by Nippon Denshoku K.K.). The value of B/W represents a percentage of image part/nonimage part. The results obtained were ranked according to the following standard:

○; The glossiness was less than 10.

X; The glossiness was not less than 10.

(Difference Between a Glossiness of Letter Part and that of Full-color Part)

An image having a monochromic letter part and a full-color solid part was printed in a full-color mode, and the difference between the glossiness of the monochromic letter part and that of the full-color solid part of the copied image on the fifth sheet was measured at 60° by means of the glossimeter (manufactured by Nippon Denshoku K.K.). The results obtained were ranked according to the following standard:

○; The difference of glossiness was less than 20.

X; The difference of glossiness was not less than 20.

(Color Reproducibility)

A solid pattern whose gradient was 255 was printed (adhesion amount; 0.55 mg/cm$^2$), and the obtained image was evaluated by a visual observation. The results were ranked according to the following standard:

○; Color reproducibility was excellent.

Δ; There was no practical problem.

X; The copied image was unusable.

(Fogging)

Directly after the printing wherein a full-color image (B/W; 30%) was printed ten times in a full-color mode, a black solid image (B/W; 0%) was printed in a full-color mode, and the printed image obtained was evaluated by a visual observation. The results were ranked according to the following standard:

○; A fogging did not occur.

Δ; Although some fogging occurred, there was no practical problem.

X; A fogging occurred remarkably, and there was a practical problem.

When the rank is on a level which is not less than the level wherein there is no practical problem, a filming on the developer-supporting member can be on a level which is not less than the level wherein there is no practical problem.

(Followability of a Black Solid)

Directly after the printing wherein a full-color image (B/W; 30%) was printed ten times in a full-color mode, a black solid image (B/W; 10%) was copied in a monochromic mode, and the copied image obtained was evaluated by a visual observation. The results were ranked according to the following standard:

○; Unevenness of concentration did not occur.

Δ; Although a slight unevenness of concentration occurred, there was no practical problem.

X; Unevenness of concentration occurred remarkably, and there was practical problem.

(Adhesion of the Toner to the Blade)

A full-color solid image was printed in a full-color mode, and the printed image on the five thousandth sheet and the blade were visually observed. The observed results were ranked according to the following standard:

○; The toner did not adhere to the blade, and an excellent image was obtained.

Δ; Although the toner adhered to the blade, an excellent image was obtained.

X; The toner adhered to the blade, and white stripes occurred, said white stripes being caused by the adhesion of the toner to the blade.

The adhesion of the toner to the blade means that the adhesion of the toner to one or more of the developing devices has occurred.

As detailedly described above, according to the present invention, (i) the easiness of reading the black letter part is kept by suppressing a glossiness of said letter part, (ii) the speed-u of the monochromic development and the excellent color reproducibility of the full-color development can be achieved, (iii) the occurrences of the toner filming on the developer-supporting member and the toner fogging on the photosensitive member can be prevented over a long period of time, (iv) the toner can satisfactorily be conveyed to the developing region, and (v) the toner adhesion to the developer-regulating member can be prevented.

TABLE 4

| | Examples | | | Comparative examples | | | | | | |
|---|---|---|---|---|---|---|---|---|---|---|
| | 1 | 2 | 3 | 1 | 2 | 3 | 4 | 5 | 6 | 7 |
| Black toner | 1 | 2 | 4 | 3 | 1 | 1 | 1 | 1 | 1 | 1 |
| C·M·Y toner | 1 | 1 | 4 | 1 | 2 | 3 | 1 | 1 | 1 | 1 |
| Developer-supporting member of the black developing device | 1 | 11 | 1 | 1 | 1 | 1 | 3 | 5 | 7 | 9 |
| Developer-supporting member of the C·M·Y developing device | 2 | 2 | 2 | 2 | 2 | 2 | 4 | 6 | 8 | 10 |
| Tanδ of the black toner | 0.95 | 0.97 | 0.95 | 1.05 | 0.95 | 0.95 | 0.95 | 0.95 | 0.95 | 0.95 |
| Tanδ of the C·M·Y toner | 1.20 | 1.20 | 1.20 | 1.20 | 0.95 | 1.30 | 1.20 | 1.20 | 1.20 | 1.20 |
| Tanδ ratio | 1.26 | 1.24 | 1.26 | 1.14 | 1.00 | 1.37 | 1.26 | 1.26 | 1.26 | 1.26 |
| $d_{50}$/Ra of the black developing device | 1.42 | 1.40 | 1.38 | 1.42 | 1.42 | 1.42 | 0.42 | 3.55 | 1.42 | 1.42 |
| $d_{50}$/Ra of the C·M·Y toner | 2.33 | 2.33 | 2.33 | 2.33 | 2.36 | 2.40 | 0.41 | 3.50 | 2.33 | 2.33 |
| Sm of developer-supporting member of the black developing device | 80 | 80 | 80 | 80 | 80 | 80 | 80 | 80 | 201 | 15 |
| Sm of developer-supporting member of the C·M·Y developing device | 50 | 50 | 50 | 50 | 50 | 50 | 50 | 50 | 201 | 15 |
| Mean roundness of the black toner | 0.962 | 0.960 | 0.950 | 0.960 | 0.962 | 0.962 | 0.962 | 0.962 | 0.962 | 0.962 |
| Mean roundness of the C·M·Y toner | 0.962 | 0.962 | 0.951 | 0.962 | 0.959 | 0.960 | 0.962 | 0.962 | 0.962 | 0.962 |
| D/$d_{50}$ of the black toner | 0.52 | 0.25 | 0.36 | 0.54 | 0.52 | 0.52 | 0.52 | 0.52 | 0.52 | 0.52 |
| D/$d_{50}$ of the C·M·Y toner | 0.54 | 0.54 | 0.35 | 0.54 | 0.52 | 0.53 | 0.54 | 0.54 | 0.54 | 0.54 |
| Glossiness of letter part | ○ | ○ | ○ | X | ○ | ○ | ○ | ○ | ○ | ○ |
| Difference between the glossiness of letter part and that of full-color part | ○ | ○ | ○ | ○ | ○ | X | ○ | ○ | ○ | ○ |
| Color reproducibility | ○ | ○ | Δ | ○ | X | ○ | ○ | ○ | ○ | ○ |
| Fogging | ○ | ○ | Δ | ○ | ○ | ○ | X | ○ | ○ | X |
| Followability of the black solid | ○ | ○ | Δ | ○ | ○ | ○ | ○ | X | X | ○ |
| Adhesion of the toner to the blade | ○ | ○ | X | ○ | ○ | Δ | ○ | ○ | ○ | ○ |

What is claimed is:

1. A developing system for forming a full-color image which comprises (i) a first developing device which is equipped with a developer-supporting member which carries one-component developer including a black toner and a regulating member which forms a thin layer of the black toner on the developer-supporting member, said developer-supporting member having a mean crest distance (Sm) of 20–200 μm on its surface and satisfying the following relation:

$$d_{50}/Ra=0.5–3.0$$

(wherein $d_{50}$ is a weight-average particle size (μm) of the black toner, and Ra is a surface roughness (μm) of the developer-supporting member), and (ii) a second developing device which is equipped with a developer-supporting member which carries one-component developer including a first color toner and a regulating member which forms a thin layer of the first color toner on the developer-supporting member, said developer-supporting member having a mean crest distance (Sm) of 20–200 μm on its surface and satisfying the following relation:

$$d_{50}/Ra=0.5–3.0$$

(wherein $d_{50}$ is a weight-average particle size (μm) of the first color toner, and Ra is a surface roughness (μm) of the developer-supporting member), wherein tan δ (150° C.) of the black toner is not more than 1.0, and a first ratio of tan δ represented by (tan δ (150° C.) of the first color toner)/(tan δ (150° C.) of the black toner) satisfies the following relation:

$$1.1 \leqq \text{the first ratio of tan } \delta \leqq 1.35; \text{ and wherein}$$

$$\tan\delta = \frac{\text{loss of elastic modulus } (G'')}{\text{storage elastic modulus } (G')}.$$

2. The developing system of claim 1, wherein tan δ (150° C.) of the black toner and the first ratio of tan δ satisfy the following relations:

$$0.85 \leqq \tan\delta(150°\text{ C.}) \leqq 1.0$$

$$1.2 \leqq \text{the first ratio of tan } \delta \leqq 1.30.$$

3. The developing system of claim 1, wherein the developer-supporting member of the first developing device has the mean crest distance (Sm) of 40–100 μm and satisfies the following relation:

$$d_{50}/Ra=0.7–2.5,$$

and the developer-supporting member of the second developing device has the mean crest distance (Sm) of 40–100 μm and satisfies the following relation:

$$d_{50}/Ra=0.7–2.5.$$

4. The developing system of claim 1, wherein the mean crest distance (Sm) of the first developing device is larger than that of the second developing device, and $d_5$/Ra relating to the first developing device is smaller than that relating to the second developing device.

5. The developing system of claim 1, wherein it comprises (i) a third developing device which is equipped with a developer-supporting member which carries one-component developer including a second color toner and a regulating member which forms a thin layer of the second color toner on the developer-supporting member, said developer-supporting member having a mean crest distance (Sm) of 20–200 μm on its surface and satisfying the following relation:

$$d_{50}/Ra=0.5–3.0$$

(wherein $d_{50}$ is a weight-average particle size (μm) of the second color toner, and Ra is a surface roughness (μm) of the developer-supporting member), and (ii) a fourth developing device which is equipped with a developer-supporting member which carries one-component developer including a third color toner and a regulating member which forms a thin layer of the third color toner on the developer-supporting member, said developer-supporting member having a mean crest distance (Sm) of 20–200 μm and satisfying the following relation:

$$d_{50}/Ra=0.5–3.0$$

(wherein $d_{50}$ is a weight-average particle size (μm) of the third color toner, and Ra is a surface roughness (μm) of the developer-supporting member), wherein a second ratio of tan δ represented by (tan δ (150°) of the second color toner)/(tan δ (150° C.) of the black toner) satisfies the following relation:

$$1.1 \leqq \text{the second ratio of tan } \delta \leqq 1.35,$$ and a third ratio of tan δ represented by (tan δ (150° C.) of the third color toner)/(tan δ (150° C.) of the black toner) satisfies the following relation:

$$1.1 \leqq \text{the third ratio of tan } \delta \leqq 1.35.$$

6. The developing system of claim 1, wherein each of the black toner and the first color toner is a nonmagnetic toner.

7. The developing system of claim 6, wherein each of the black toner and the first color toner has a mean roundness of not less than 0.950, a standard deviation of roundness of not more than 0.040 and $D/d_{50}$ of not less than 0.4, wherein D equals 6/(ρ·S) (wherein ρ is a true density (g/cm$^3$) of the toner, and S is BET specific surface area of the toner).

8. The developing system of claim 7, wherein each of the black toner and the first color toner has the mean roundness of not less than 0.960, the standard deviation of roundness of not more than 0.035 and $D/d_{50}$ of 0.40–0.80.

9. The developing system of claim 5, wherein each of the black toner, the first color toner, the second color toner and the third color toner is a nonmagnetic toner.

10. The developing system of claim 9, wherein each of the black toner, the first color toner, the second color toner and the third color toner has the mean roundness of not less than 0.950, the standard deviation of roundness of not more than 0.040 and $D/d_{50}$ of not less than 0.40, wherein D=6/(ρ·S) (wherein ρ is a true density (g/cm$^3$) of the toner, and S is BET specific surface area of the toner).

11. The developing system of claim 10, wherein each of the black toner, the first color toner, the second color toner and the third color toner has the mean roundness of not less than 0.960, the standard deviation of roundness of not more than 0.035 and $D/d_{50}$ of 0.40–0.80.

12. The developing system of claim 1, wherein the black toner is a magnetic toner, and the first color toner is a nonmagnetic toner.

13. The developing system of claim 12, wherein the black toner has a mean roundness of not less than 0.950, the standard deviation of roundness of not more than 0.040 and $D/d_{50}$ of not less than 0.20, and the first color toner has a mean roundness of not less than 0.950, the standard deviation of roundness of not more than 0.040 and $D/d_{50}$ of not less than 0.40, wherein D=6/(ρ·S)(wherein ρ is a true density (g/cm$^3$) of the toner, and S is BET specific surface area of the toner).

14. The developing system of claim 5, wherein the black toner is a magnetic toner, and each of the first color toner, the second color toner and the third color toner is a nonmagnetic toner.

15. The developing system of claim 14, wherein the black toner has a mean roundness of not less than 0.90, the standard deviation of roundness of not more than 0.040 and $D/d_{50}$ of not less than 0.20, each of the first color toner, the second color toner and the third color toner has the mean roundness of not less than 0.950, the standard deviation of roundness of not more than 0.040 and $D/d_{50}$ of not less than 0.40, wherein D=6/(ρ·S)(wherein ρ is a true density (g/cm$^3$) of the toner, and S is BET specific surface area of the toner).

16. The developing system of claim 15, wherein the black toner has a mean roundness of not less than 0.960, the standard deviation of roundness of not more than 0.035 and $D/d_{50}$ of 0.20–0.55, and each of the first color toner, the second color toner and the third color toner has the mean roundness of not less than 0.960, the standard deviation of roundness of not more than 0.035 and $D/d_{50}$ of 0.40–0.80.

17. The developing system of claim 5, wherein a first inorganic particle and a second inorganic particle whose specific surface area is different from that of the first inorganic particle are externally added to the black toner, the first color toner, the second color toner and the third color toner.

18. The developing system of claim 17, wherein an absolute value of a difference between BET specific surface area of the first inorganic particle and that of the second inorganic particle is not less than 30 m$^2$/g.

19. The developing system of claim 17, wherein a third inorganic particle and a fourth inorganic particle whose BET specific surface area is different from that of the third inorganic particle are fixed to the black toner, the first color toner, the second color toner and the third color toner.

20. The developing system of claim 1, wherein the regulating member is an elastic blade whose thickness is 0.08–0.2 mm.

* * * * *